United States Patent [19]

Ikegawa et al.

[11] Patent Number: 4,889,796

[45] Date of Patent: Dec. 26, 1989

[54] SILVER HALIDE PHOTOGRAPHIC EMULSION

[75] Inventors: Akihiko Ikegawa; Yuichi Ohashi; Masaki Okazaki, all of Minami-Ashigara, Japan

[73] Assignee: Fuji Photo Film Co., Ltd., Minami-Ashigara, Japan

[21] Appl. No.: 136,991

[22] Filed: Dec. 23, 1987

[30] Foreign Application Priority Data

Dec. 27, 1986 [JP] Japan ..... 61-314596

[51] Int. Cl.[4] ..... G03C 1/19; G03C 1/28

[52] U.S. Cl. ..... 430/549; 430/550; 430/567; 430/574; 430/588

[58] Field of Search ..... 430/574, 549, 550, 567

[56] References Cited

U.S. PATENT DOCUMENTS

| | | | |
|---|---|---|---|
| 2,521,959 | 9/1950 | Anish | 430/588 |
| 3,864,134 | 2/1975 | Ueda et al. | 96/124 |
| 4,362,813 | 12/1982 | Mihara et al. | 430/574 |
| 4,551,424 | 11/1985 | Ikeda et al. | 430/588 |
| 4,571,380 | 2/1986 | Noguchi et al. | 430/574 |

FOREIGN PATENT DOCUMENTS 709873 8/1941 Fed. Rep. of Germany .

*Primary Examiner*—Richard L. Schilling

*Attorney, Agent, or Firm*—Burns, Doane, Swecker & Mathis

[57] ABSTRACT

A silver halide photographic emulsion which contains at least one of the compounds represented by the following general formula (I), and at least one compound selected from the group consisting of the compounds represented by the general formula (II) and the compounds represented by the general formula (III): General formula (I)

wherein $R_0$ and $R_1$ may be the same or different, and represent hydrogen atoms, alkyl, aryl, alkoxy, aryloxy groups, halogen atoms, alkoxycarbonyl, acylamino, acyl, cyano carbamoyl, sulfamoyl, carboxyl, or acyloxy groups under the condition that $R_0$ and $R_1$ do not represent hydrogen atoms at the same time; $R_2$ represents a hydrogen atom, alkyl, or aryl, $R_3$ represents alkyl, aryl, alkoxy, aryloxy, acyl, acyloxy, alkoxycarbonyl, or acylamino group and moreover $R_3$ is required to be a substituent having such L and B that S value is 544 or less in the equation of $$S=3.536L-2.661B+535.4$$

wherein L (its unit is Å) represents "L" as a STERIMOL parameter, and B (its unit is Å) represents the smaller value among $B_1+B_4$ and $B_2+B_3$ which are STERIMOL parameters, under the condition that $R_1$ and $R_3$, or $R_0$ and $R_3$ do not represent aryl groups at the same time; $R_4$ and $R_5$ may be the same, and represent alkyl groups; $X_1\ominus$ represents a counter anion; and l is 0 or 1, and when an inner salt is formed, l is 0; General formula (II)

wherein $Z_1$ and $Z_2$ may be the same or different, and represent nonmetal atomic groups necessary for forming benzene rings, or naphthalene rings under the condition that $Z_1$ and $Z_2$ do not form naphthalene rings at the same time, and under the further condition that when $Z_1$ and/or $Z_2$ represent benzene rings having a substituent, the substituent does not represent a substituent defined as $R_3$; $R_7$ has the same significance with $R_2$; $R_6$ and $R_8$ have the same significances with $R_4$ and $R_5$ respectively; $X_2\ominus$ has the same significance with $X_1\ominus$; and n has the same significance with l; General formula (III)

wherein $Z_3$ and $Z_4$ may be the same or different, and represent nonmetal atomic groups necessary for forming benzene rings; Y represents a sulfur atom or a selenium atom; $R_9$ and $R_{11}$ have the same significances with $R_4$ and $R_5$ respectively; $R_{10}$ has the same significance with $R_2$; $X_3\ominus$ has the same significance with $X_1\ominus$, and n has the same significance with l.

Photographic light-sensitive materials which have been coated with this emulsion have elevated spectral sensitivities in green short wavelength region and excellent preservabilities and stabilities.

17 Claims, No Drawings

SILVER HALIDE PHOTOGRAPHIC EMULSION

BACKGROUND OF THE INVENTION

1. Field of the Invention

This invention relates to a silver halide photographic emulsion, and particularly relates to a silver halide photographic emulsion having an elevated spectral sensitivity in green color light wavelength region. More specifically, the present invention relates to a silver halide photographic emulsion which can give photographic light-sensitive materials having an elevated spectral sensitivities in green short wavelength region and excellent preservabilities and stabilities.

2. Description of the Prior Art

As silver halide photographic emulsions having an elevated spectral sensitivity in a green wavelength region, silver halide photographic emulsions wherein an oxacarbocyanine dye and an imidacarbocyanine dye are used together (for example, Japanese Patent Unexamined published application (hereinafter referred to as "J. P. KOKAI") Nos. 59-116646, 59-116647, 59-140443, 59-149346 and the like), those wherein an oxacarbocyanine dye and an oxathiacarbocyanine dye are used together (for example, Japanese Patent Publication for Opposition Purpose (hereinafter referred to as "J. P. KOKOKU") No. 46-11627, J. P. KOKAI No. 60-42750 and the like), those wherein two or more oxacarbocyanine dyes are used together (for example, J. P. KOKAI No. 52-23931 and the like), and the like have hitherto been known. However, any of those photographic emulsions has only a low spectral sensitivity in a green short wavelength region, which resulted in a problem in color reproduction.

On the other hand, as sensitizing dyes having a maximal value of spectral sensitivity between 520 nm and 545 nm, benzimidazolooxazolocarbocyanine dyes (for example, compounds disclosed in J. P. KOKOKU No. 44-14030 and the like) and dimethinemerocyanine dyes (for example, compounds disclosed in U.S. Pat. Nos. 2493748, 2519001 and 3480439 and the like) have hitherto been known. Thus, to solve the above problem, using together a further sensitizing dye having a maximal value of spectral sensitivity between 520 nm and 545 nm may be thought of. However, in emulsions containing a benzimidazolooxazolocarbocyanin or a dimethinemerocyanine, increase of fog after application of the emulsions under a high temperature or a condition of high temperature and high humidity, or lowering of sensitivity owing to poorness of stability with time lapse after application of the emulsions is observed. Thus, such a dye does not seem to be suitable for using together.

Under the above circumstances, development of a photographic emulsion which is free from the above drawbacks and has a maximal value of spectral sensitivity in a green short wavelength region, and wherein a new sensitizing dye is used has been desired.

SUMMARY OF THE INVENTION

The present invention relates to spectral sensitization of a silver halide photographic emulsion, and the first object of the present invention is to provide a silver halide photographic emulsion having an elevated spectral sensitivity in a green wavelength region.

The second object of the present invention is to provide photographic light-sensitive materials which have elevated spectral sensitivities in a green short wavelength region and are excellent in preservability and stability.

The above objects of the present invention have been accomplished by a silver halide photographic emulsion which contains at least one of the compounds represented by the following general formula (I), and at least one compound selected from the group consisting of the compounds represented by the general formula (II) and the compounds represented by the general formula (III):

General formula (I)

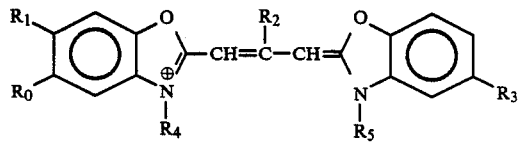

wherein $R_0$ and $R_1$ may be the same or different, and represent hydrogen atoms, alkyl groups, aryl groups, alkoxy groups, aryloxy groups, halogen atoms, alkoxycarbonyl groups, acylamine groups, acyl groups, cyano groups, carbamoyl groups, sulfamoyl groups, carboxyl groups or acyloxy groups under the condition that $R_0$ and $R_1$ do not represent hydrogen atoms at the same time; $R_2$ represents a hydrogen atom, an alkyl group or an aryl group; $R_3$ represents an alkyl group having 2 or more carbon atoms, an aryl group, an alkoxy group having 2 or more carbon atoms, an aryloxy group, an acyl group having 3 or more carbon atoms, an acyloxy group having 3 or more carbon atoms, an alkoxycarbonyl group having 4 or more carbon atoms, or an acylamino group having 3 or more carbon atoms, and moreover $R_3$ is required to be a substituent having such L and B that S value is 544 or less in the equation of $$S=3.536L-2.661B+535.4$$

wherein L represents "L" (its unit is Å) as a STERIMOL parameter disclosed in A. Verloop, W. Hoogenstraaten, J. Tipker: "Drug Design, Vol. VII", (E. J. Ariëns Ed.) Academic Press, New York (1976), pp. 180–185 and the like, and B represents the smaller value among $B_1+B_4$ and $B_2+B_3$ (their units are Å) which are parameters of STERIMOL, under the condition that $R_0$ and $R_3$, or $R_1$ and $R_3$ do not represent aryl groups at the same time; $R_4$ and $R_5$ may be the same or different, and represent alkyl groups; $X_1^{\ominus}$ represents a counter anion; and l is 0 or 1, and when an inner salt is formed, l is 0;

General formula (II)

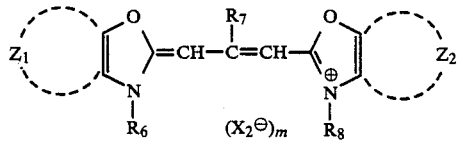

wherein $Z_1$ and $Z_2$ may be the same or different, and represent nonmetal atomic groups necessary for forming benzene rings or naphthalene rings under the condition that $Z_1$ and $Z_2$ do not form naphthalene rings at the same time, and under the further condition that when $Z_1$ and/or $Z_2$ represent benzene rings having a substituent, the substituent does not represent a substituent defined as $R_3$; $R_7$ has the same significances with $R_2$; $R_6$ and $R_8$ have the same significance with $R_4$ and $R_5$ respectively; $X_2\ominus$ has the same significance with $X_1\ominus$; and n has the same significance with l;

General formula (III)

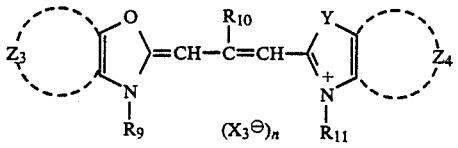

wherein $Z_3$ and $Z_4$ may be the same or different, and represent nonmetal atomic groups necessary for forming benzene rings; Y represents a sulfur atom or a selenium atom; $R_9$ and $R_{11}$ have the same significances with $R_4$ and $R_5$ respectively; $R_{10}$ has the same significances with $R_2$; $X_3\ominus$ has the same significance with $X_1\ominus$, and n has the same significance with l.

Alkyl groups in the definition of $R_0$ and $R_1$ may include those having substituent(s). Preferred alkyl groups include those having 10 or less carbon atoms, for example a methyl group, an ethyl group, a propyl group, an isopropyl group, a butyl group, a branched butyl group (e.g. an isobutyl group and a t-butyl group), a pentyl group, a branched pentyl group (e.g. isopentyl group and a t-pentyl group), a vinylmethyl group, a cyclohexyl group, a benzyl group, a phenethyl group, a 3-phenylpropyl group, a trifluoromethyl group, and the like.

Aryl groups in the definition of $R_0$ and $R_1$ may include those having substituent(s). Preferred aryl groups include those having 10 or less carbon atoms, for example a phenyl group, a 4-methylphenyl group, a 4-chlorophenyl group, a naphthyl group, and the like.

Alkoxy groups in the definition of $R_0$ and $R_1$ may include those having substituent(s). Preferred alkoxy groups include those having 10 or less carbon atoms, for example a methoxy group, an ethoxy group, a propyloxy group, a butyloxy group, a pentyloxy group, a benzyloxy group, a phenethyloxy group and the like.

Aryloxy groups in the definition of $R_0$ and $R_1$ may include those having substituent(s). Preferred aryloxy groups include those have 10 or less carbon atoms, for example a phenoxy group, a 4-methylphenoxy group, a 4-chlorophenoxy group, a naphthyloxy group and the like.

Halogen atoms in the definition of $R_0$ and $R_1$ include fluorine, chlorine, bromine and iodine atoms.

Alkoxycarbonyl groups in the definition of $R_0$ and $R_1$ may include those having substituent(s). Preferred alkoxycarbonyl groups include those having 10 or less carbon atoms, for example a methoxycarbonyl group, an ethoxycarbonyl group, a benzyloxycarbonyl group and the like.

Acylamino groups in the definition of $R_0$ and $R_1$ may include those having substituent(s). Preferred acylamino groups include those having 8 or less carbon atoms, for example an acetylamino group, a trifluoroacetylamino group, a propionylamino group, a benzoylamino group and the like.

Acyl groups in the definition of $R_0$ and $R_1$ may include those having substituent(s). Preferred acyl groups include those having 10 or less carbon atoms, for example an acetyl group, a trifluoroacetyl group, a propionyl group, a benzoyl group, a p-chlorobenzoyl group, a mesyl group and the like.

Carbamoyl groups in the definition of $R_0$ and $R_1$ may include those having substituent(s). Preferred carbamoyl groups include those having 6 or less carbon atoms, for example a carbamoyl group, an N,N-dimethylcarbamoyl group, a morpholinocarbonyl group and the like.

Sulfamoyl groups in the definition of $R_0$ and $R_1$ may include those having substituent(s). Preferred sulfamoyl groups include those having 6 or less carbon atoms, for example a sulfamoyl group, an N,N-dimethylsulfamoyl group, a morpholinosulfonyl group, a piperidinosulfonyl group and the like.

Acyloxy groups in the definition of $R_0$ and $R_1$ may include those having substituent(s). Preferred acyloxy groups include those having 10 or less carbon atoms, for example an acetyloxy group, a trifluoroacetyloxy group, a propionyloxy group, a benzoyloxy group and the like.

$R_0$ and $R_1$ may also be hydrogen atoms, cyano groups or carboxyl groups, under the condition that $R_0$ and $R_1$ do not represent hydrogen atoms at the same time.

The most preferred combination of $R_0$ and $R_1$ is that of $R_0$ being a hydrogen atom and $R_1$ being a phenyl group substituted at the 5-position.

Alkyl group and aryl group in the definition of $R_2$ may each include those having substituent(s). Preferred alkyl groups and aryl groups include alkyl groups having 10 or less carbon atoms, for example a methyl group, an ethyl group, a propyl group, a butyl group, a benzyl group, a phenethyl group, a phenylpropyl group and the like; and aryl groups having 10 or less carbon atoms, for example a phenyl group, a p-tolyl group and the like, respectively.

$R_2$ may also be a hydrogen atom.

Alkyl group, aryl group, alkoxy group, aryloxy group, acyl group, acyloxy group, alkoxycarbonyl group and acylamino group in the definition of $R_3$ may each include those having substituent(s), with the condition that $R_1$ and $R_3$ do not represent aryl groups at the same time. Preferred $R_3$ groups include, for example, an ethyl group, a propyl group, an isopropyl group, a branched butyl group (e.g. a t-butyl group), a branched pentyl group (e.g. an isopentyl group and a t-pentyl group), a branched hexyl group (e.g. a 3,3-dimethylbutyl group), a cyclohexyl group, a branched octyl group (e.g. a t-octyl group), a benzyl group, a phenethyl group, a t-butylcarbonyloxy group and the like. Most preferred examples of $R_3$ include an ethyl group, a propyl group, an isopropyl group, a t-butyl group, a t-pentyl group, a cyclohexyl group, a t-octyl group and a benzyl group.

Alkyl groups in the definition of $R_4$ and $R_5$ may include those having substituent(s). Preferred alkyl groups include those having 8 or less carbon atoms such as methyl, ethyl, propyl, vinylmethyl, butyl, pentyl, hexyl, heptyl and octyl groups; aralkyl groups having 10 or less carbon atoms such as benzyl, phenethyl and 3-phenylpropyl groups; and alkyl groups having 6 or less carbon atoms substituted with an alkoxycarbonyl group having 8 or less carbon atoms (e.g. a methoxycarbonyl, ethoxycarbonyl or benzyloxycarbonyl group), an alkoxy group having 8 or less carbon atoms (e.g. a methoxy, ethoxy, butyloxy, benzyloxy or phenethyloxy group), an aryloxy group having 8 or less carbon atoms (e.g. a phenoxy or p-tolyloxy group), an acyloxy group having 8 or less carbon atoms (e.g. an acetyloxy, propionyloxy or benzoyloxy group), an acyl group having 8 or less carbon atoms (e.g. an acetyl, propionyl, benzoyl or 4-fluorobenzoyl group), a carbamoyl group having 6 or less carbon atoms (e.g. a carbamoyl, N,N-dimethylcarbamoyl, morpholinocarbamoyl or piperidinocarbamoyl group), a sulfamoyl group having 6 or less carbon atoms (e.g. a sulfamoyl, N,N-dimethylsulfamoyl, morpholinosulfonyl or piperidinosulfonyl group), or an aryl group having 10 or less carbon atoms (e.g. a phenyl, p-fluorophenyl, p-hydroxyphenyl, p-carboxyphenyl or p-sulfophenyl group).

Further, either $R_4$ or $R_5$ is preferably a sulfoalkyl group or a carboxyalkyl group.

$X_1\ominus$ represents an inorganic or organic acid anion, for example chloride, bromide, iodide, p-toluenesulfonate, p-nitrobenzenesulfonate, methanesulfonate, methylsulfate, ethylsulfate, perchlorate and the like.

Benzene rings or naphthalene rings which $Z_1$ and/or $Z_2$ each form may include those having substituent(s). Examples of heterocyclic part formed by combination with $Z_1$ or $Z_2$ as represented as benzoxazoles include, for example, benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-butoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-amyloxybenzoxazole, 6-hydroxybenzoxazole, 5,6-dimethylbenzoxazole, 4,6-dimethylbenzoxazole, 5-ethoxybenzoxazole, naphtho(2,1-d)oxazole, naphtho(1,2-d)oxazole, naphtho(2,3-d)oxazole, 5-nitronaphtho(2,1-d)oxazole and the like.

Most preferred examples of heterocyclic part formed by combination with $Z_1$ or $Z_2$ as represented as benzoxazoles include 5-chlorobenzoxazole, 5-bromobenzoxazole, 5-fluorobenzoxazole, 5-phenylbenzoxazole, 5-methoxybenzoxazole, 5,6-dimethylbenzoxazole, naphtho(2,1-d)oxazole, naphtho(1,2-d)oxazole, naphtho(2,3-d)oxazole and the like.

$R_6$ and $R_8$ have the same significances with $R_4$ and $R_5$ respectively. $R_7$ has the same significance with $R_2$. Most preferred ones as $R_7$ group are, for example, an ethyl group and the like. $X_2\ominus$ has the same significance with $X_1\ominus$, and m has the same significance with l.

Benzene rings which $Z_3$ and/or $Z_4$ each form may include those having substituent(s). Examples of heterocyclic part formed by combination with $Z_3$ as represented as benzoxazoles include, for example, benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-butoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-amyloxybenzoxazole, 6-hydroxybenzoxazole, 5,6-dimethylbenzoxazole, 4,6-dimethylbenzoxazole, 5-ethoxybenzoxazole, and the like.

Examples of heterocyclic part formed by combination with $Z_4$ as represented as benzothiazoles or benzoselenazoles include, for example, benzothiazole, benzoselenazole, 5-chlorobenzothiazole, 5-chlorobenzoselenazole, 5-methylbenzothiazole, 5-methylbenzoselenazole, 5-bromobenzothiazole, 5-bromobenzoselenazole, 5-fluorobenzothiazole, 5-fluorobenzoselenazole, 5-phenylbenzothiazole, 5-phenylbenzoselenazole, 5-methoxybenzothiazole, 5-methoxybenzoselenazole, 5-butoxybenzothiazole, 5-butoxybenzoselenazole, 5-nitrobenzothiazole, 5-nitrobenzoselenazole, 5-trifluoromethylbenzothiazole, 5-trifluoromethylbenzoselenazole, 5-hydroxybenzothiazole, 5-hydroxybenzoselenazole, 5-carboxybenzothiazole, 5-carboxybenzoselenazole, 6-methylbenzothiazole, 6-methylbenzoselenazole, 6-chlorobenzothiazole, 6-chlorobenzoselenazole, 6-nitrobenzothiazole, 6-nitrobenzoselenazole, 6-methoxybenzothiazole, 6-methoxybenzoselenazole, 6-amyloxybenzothiazole, 6-amyloxybenzoselenazole, 6-hydroxybenzothiazole, 6-hydroxybenzoselenazole, 5,6-dimethylbenzothiazole, 5,6-dimethylbenzoselenazole, 4,6-dimethylbenzothiazole, 4,6-dimethylbenzoselenazole, 5-ethoxybenzothiazole, 5-ethoxybenzoselenazole, 5-chloro-6-methylbenzothiazole, 5-chloro-6-methylbenzoselenazole and the like.

Typical examples of the compounds represented by the above general formulae (I) to (III) as used in the present invention are enumerated below, but the scope of the present invention should not be construed to be limited thereto.

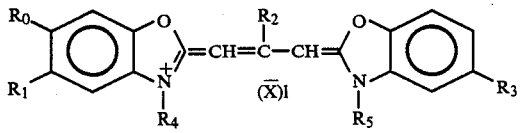

| | $R_0$ | $R_1$ | $R_2$ | $R_3$ | $R_4$ | $R_5$ | X | l |
|---|---|---|---|---|---|---|---|---|
| I-1 | H | 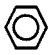 | H | $(CH_2)_2CH_3$ | $(CH_2)_4$ $\vert$ $SO_3^-$ | $(CH_2)_4$ $\vert$ $SO_3H.N(C_2H_5)_3$ | — | 0 |
| I-2 | H | 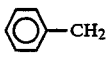 | $CH_3$ | $C_2H_5$ | $(CH_2)_4$ $\vert$ $SO_3^-$ | $C_2H_5$ | — | 0 |
| I-3 | H | 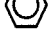 | $C_2H_5$ | $CH_3$ $\vert$ $C-CH_3$ $\vert$ $CH_3$ | $(CH_2)_2$ $\vert$ $SO_3^-$ | $(CH_2)_4$ $\vert$ $SO_3H$ | — | 0 |

-continued

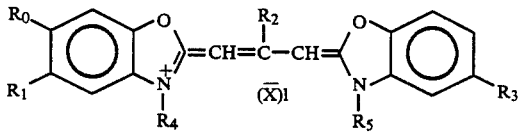

| | $R_0$ | $R_1$ | $R_2$ | $R_3$ | $R_4$ | $R_5$ | X | l |
|---|---|---|---|---|---|---|---|---|
| I-4 | H | 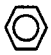 | $CH_3$ | $CH_3$<br>\|<br>C—$C_2H_5$<br>\|<br>$CH_3$ | $(CH_2)_2$<br>\|<br>$SO_3^-$ | $(CH_2)_4$<br>\|<br>$SO_3Na$ | — | 0 |
| I-5 | H | $CH_3$<br>\|<br>$C_2H_5$—C<br>\|<br>$CH_3$ | $C_2H_5$ | $CH_3$<br>\|<br>C—$CH_3$<br>\|<br>$CH_3$ | $(CH_2)_3$<br>\|<br>$SO_3^-$ | $(CH_2)_3$<br>\|<br>$SO_3K$ | — | 0 |
| I-6 | H | 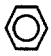 | $C_2H_5$ | 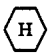 | $(CH_2)_2$<br>\|<br>$SO_3^-$ | $(CH_2)_3$<br>\|<br>$SO_3H.N(C_2H_5)_3$ | — | 0 |
| I-7 | H | 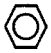 | $C_2H_5$ | $CH_3$<br>\|<br>C—$C_2H_5$<br>\|<br>$CH_3$ | $(CH_2)_2$<br>\|<br>$SO_3^-$ | $(CH_2)_4$<br>\|<br>$SO_3Na$ | — | 0 |
| I-8 | H | Cl | $CH_3$ | $CH_2$— 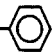 | $(CH_2)_3$<br>\|<br>$SO_3^-$ | $(CH_2)_3$<br>\|<br>$SO_3H.N(C_2H_5)_3$ | — | 0 |
| I-9 | H | $CH_3$ | $C_2H_5$ | $CH_2$— 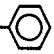 | $C_2H_5$ | $C_2H_5$ | $CH_3$— 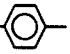 —$SO_3^-$ | 1 |
| I-10 | H | $(CH_3)_2NSO_2$ | $(CH_2)_2CH_3$ | $CH(CH_3)_2$ | $C_2H_5$ | $(CH_2)_3$<br>\|<br>$SO_3^-$ | — | 0 |
| I-11 | 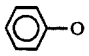 | H | $C_2H_5$ | $CH_3$<br>\|<br>C—$CH_3$<br>\|<br>$CH_3$ | $(CH_2)_4$<br>\|<br>$SO_3^-$ | $(CH_2)_4$<br>\|<br>$SO_3H.N(C_2H_5)_3$ | — | 0 |
| I-12 | $CH_3(CH_2)_4O$ | H | $CH_2$— 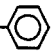 | $CH_2CH_2$— | $(CH_2)_4$<br>\|<br>$SO_3^-$ | $(CH_2)_2$<br>\|<br>$SO_3Na$ | — | 0 |
| I-13 | HOOC | H | $C_2H_5$ | $CH_3$<br>\|<br>OCOC—$CH_3$<br>\|<br>$CH_3$ | $(CH_2)_3$<br>\|<br>$SO_3^-$ | $C_2H_5$ | — | 0 |
| I-14 | $CH_3$<br>\|<br>NCO<br>\|<br>$CH_3$ | H | H | $CH_3$<br>\|<br>$CH_2CH_2$—C—$CH_3$<br>\|<br>$CH_3$ | $(CH_2)_4$<br>\|<br>$SO_3^-$ | $CH_3$ | — | 0 |
| I-15 | H | 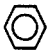 | $C_2H_5$ | $CH_3$<br>\|<br>C—$C_2H_5$<br>\|<br>$CH_3$ | $C_2H_5$ | $C_2H_5$ | $Br^-$ | 1 |
| I-16 | $CH_3O$ | H | $CH_3$ | $CH_2$— 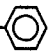 | $CH_3$ | $(CH_2)_3$<br>\|<br>$SO_3^-$ | — | 0 |
| I-17 | Cl | H | H | 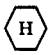 | $(CH_2)_3$<br>\|<br>$SO_3^-$ | $(CH_2)_4$<br>\|<br>$SO_3K$ | — | 0 |
| I-18 | H | 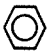 | $C_2H_5$ | $CH_3$ $CH_3$<br>\| \|<br>C—$CH_2$—C—$CH_3$<br>\| \|<br>$CH_3$ $CH_3$ | $(CH_2)_2$<br>\|<br>$SO_3^-$ | $(CH_2)_4$<br>\|<br>$SO_3Na$ | — | 0 |

-continued

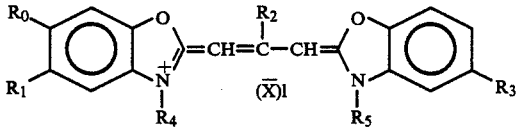

| | $R_0$ | $R_1$ | $R_2$ | $R_3$ | $R_4$ | $R_5$ | X | l |
|---|---|---|---|---|---|---|---|---|
| I-19 | H | 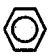 | $C_2H_5$ | $CH_2$— 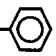 | $(CH_2)_2$ $SO_3^-$ | $(CH_2)_4$ $SO_3H$ | — | 0 |
| I-20 | $CH_3$ | $CH_3$ | $C_2H_5$ | $CH_3$ $C$—$C_2H_5$ $CH_3$ | $(CH_2)_3$ $SO_3^-$ | $(CH_2)_3$ $SO_3Na$ | — | 0 |

The values of L and B of various examples of the substituent $R_3$, and the values of B calculated using the equation of $$S=3.536L-2.66lB+535.4$$

are shown in the following table.

| Substituent $R_3$ | L(Å) | B(Å) | S |
|---|---|---|---|
| $-C_2H_5$ | 4.11 | 3.80 | 540 |
| $-C_3H_7^{(n)}$ | 5.05 | 3.80 | 543 |

-continued

| Substituent $R_3$ | L(Å) | B(Å) | S |
|---|---|---|---|
| $-C_3H_7^{(i)}$ | 4.11 | 5.20 | 536 |
| $-C_4H_9^{(i)}$ | 4.11 | 5.56 | 535 |
| $-C_5H_{11}^{(i)}$ | 5.05 | 5.72 | 538 |
| $-C_2H_4C(CH_3)_3$ | 6.17 | 5.56 | 542 |
| $-CH_2C_6H_5$ | 3.63 | 6.22 | 533 |
| $-C_6H_{11}^{(cyclo)}$ | 6.17 | 5.53 | 543 |
| $-C_2H_4C_6H_5$ | 4.63 | 6.22 | 535 |
| $-OCOC(CH_3)_3$ | 5.96 | 5.56 | 542 |
| $-C_8H_{17}^{(i)}$ | 6.00 | 5.72 | 541 |
| $-C_6H_5$ | 6.28 | 3.40 | 549 |

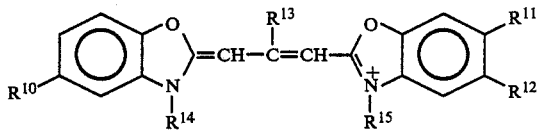

| | $R^{10}$ | $R^{11}$ | $R^{12}$ | $R^{13}$ | $R^{14}$ | $R^{15}$ |
|---|---|---|---|---|---|---|
| II-1 | 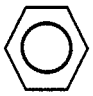 | H | 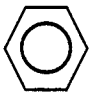 | $C_2H_5$ | $(CH_2)_2SO_3^-$ | $(CH_2)_2SO_3HN$ 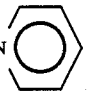 |
| II-2 | 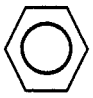 | H | Cl | $C_2H_5$ | $(CH_2)_2SO_3^-$ | $(CH_2)_3SO_3H.N(C_2H_5)_3$ |
| II-3 | Cl | H | Cl | $C_2H_5$ | $(CH_2)_3SO_3^-$ | $(CH_2)_3SO_3Na$ |
| II-4 | $OCH_3$ | H | $OCH_3$ | $C_2H_5$ | $(CH_2)_3SO_3^-$ | $(CH_2)_3SO_3K$ |
| II-5 | 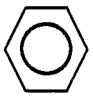 | H | $O(CH_2)_3CH_3$ | $C_2H_5$ | $(CH_2)_3SO_3^-$ | $(CH_2)_3SO_3K$ |
| II-6 | $OCH_3$ | H | $OCH_3$ | $CH_3$ | $(CH_2)_3SO_3^-$ | $(CH_2)_3SO_3Na$ |
| II-7 | Cl | H | Cl | H | $(CH_2)_4SO_3^-$ | $(CH_2)_4SO_3Na$ |
| II-8 | 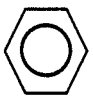 | H | 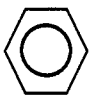 | $CH_2$— 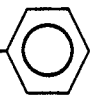 | $(CH_2)_3SO_3^-$ | $(CH_2)_3SO_3H$ |
| II-9 | 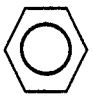 | H | Cl | $C_2H_5$ | $(CH_2)_2SO_3^-$ | $C_2H_5$ |

-continued

| | | | | | | |
|---|---|---|---|---|---|---|
| II-10 | 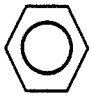 | H | 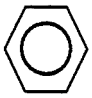 | $C_2H_5$ | $(CH_2)_2SO_3^-$ | $CH_3$ |
| II-11 | 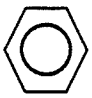 | H | $nC_4H_9$ | $C_2H_5$ | $(CH_2)_2SO_3^-$ | $(CH_2)_2SO_3Na$ |
| II-12 | $nC_4H_9$ | H | $OC_4H_9(n)$ | $C_2H_5$ | $(CH_2)_3SO_3^-$ | $(CH_2)_3SO_3K$ |
| II-13 | H | $CH_3$ | H | $(CH_2)_3SO_3^-$ | $(CH_2)_3SO_3K$ | |
| $CH_3$ | | | | | | |
| II-14 | 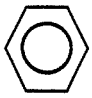 | $OC_5H_{11}(n)$ | H | $C_2H_5$ | $(CH_2)_3SO_3^-$ | $(CH_2)_4SO_3H$ |
| II-15 | $OC_4H_9(n)$ | H | $OC_4H_9(n)$ | H | $(CH_2)_4SO_3^-$ | $(CH_2)_4SO_3H$ |
| II-16 | $OC_7H_{15}(n)$ | H | $OC_7H_{15}(n)$ | $CH_3$ | $(CH_2)_3SO_3^-$ | $(CH_2)_3SO_3H.N(C_2H_5)_3$ |
| II-17 | 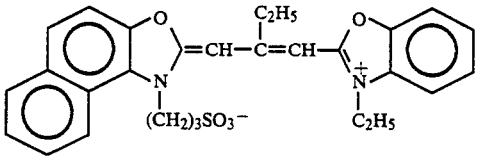 | | | | | |

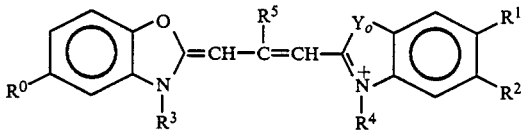

| | $Y_0$ | $R^0$ | $R^1$ | $R^2$ | $R^3$ | $R^4$ | $R^5$ |
|---|---|---|---|---|---|---|---|
| III-1 | S | 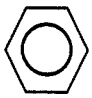 | H | Cl | $(CH_2)_3SO_3^-$ | $(CH_2)_3SO_3Na$ | $C_2H_5$ |
| III-2 | S | 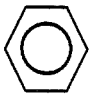 | $CH_3$ | $CH_3$ | $(CH_2)_3SO_3^-$ | $(CH_2)_4SO_3Na$ | $C_2H_5$ |
| III-3 | S | 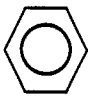 | H | $OCH_3$ | $(CH_2)_3SO_3^-$ | $(CH_2)_3SO_3K$ | $C_2H_5$ |
| III-4 | S | Cl | H | $CH_3$ | $(CH_2)_3SO_3^-$ | $C_2H_5$ | $C_2H_5$ |
| III-5 | S | 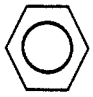 | $CH_3$ | Cl | $(CH_2)_2SO_3^-$ | $(CH_2)_4SO_3H.N(C_2H_5)_3$ | $C_2H_5$ |
| III-6 | S | 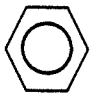 | H | 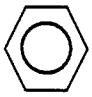 | $(CH_2)_2SO_3^-$ | $(CH_2)_4SO_3Na$ | $CH_3$ |
| III-7 | S | 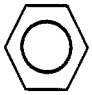 | $CH_3$ | $CH_3$ | $(CH_2)_2SO_3^-$ | $(CH_2)_2$- 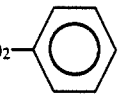 | $C_2H_5$ |
| III-8 | S | Cl | H | H | $(CH_2)_3SO_3^-$ | $C_2H_5$ | $C_2H_5$ |

-continued

| | | | | | | | |
|---|---|---|---|---|---|---|---|
| III-9 | S | Cl | H | $OCH_3$ | $(CH_2)_3SO_3^-$ | $(CH_2)_3SO_3H.N$ 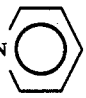 | $C_2H_5$ |
| III-10 | S | 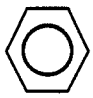 | H | H | $(CH_2)_3SO_3^-$ | $CH_3$ | H |
| III-11 | $S_e$ | Cl | H | Cl | $(CH_2)_3SO_3^-$ | $(CH_2)_3SO_3Na$ | $C_2H_5$ |
| III-10 | $S_e$ | 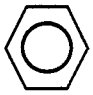 | H | H | $(CH_2)_3SO_3^-$ | $C_2H_5$ | $CH_3$ |

Sensitizing dyes represented by the general formulae (I), (II) and (III) as used in the present invention, and the like can readily be synthesized according to methods disclosed in F. M. Hamer, "Heterocyclic Compounds—Cyanine dyes and related compounds—" chapters IV, V and VI, pages 86–199, John Wiley & Sons (New York, London) (1964); D. M. Sturmer, "Heterocyclic Compounds—Special topics in heterocyclic chemistry—" chapter VIII, sec. IV pages 482–515, John Wiley & Sons (New York, London) (1977); and the like.

A sensitizing dye used in the present invention can directly be dispersed in an emulsion. Alternatively, it can first be dissolved in a suitable solvent, for example methyl alcohol, ethyl alcohol, methyl cellosolve, acetone, water or pyridine or a mixed solvent thereof, and then added to an emulsion as a solution. Ultrasonic wave can be used to dissolve it. As a method for addition of this sensitizing dye, a method as disclosed in U.S. Pat. No. 3,469,987 or the like wherein a dye is dissolved in a volatile organic solvent, the solution is dispersed in a hydrophilic colloid, and the dispersion is added to an emulsion; a method as disclosed in J. P. KOKOKU No. 46-24185 or the like wherein a water insoluble dye is dispersed in a water soluble solvent without dissolving it, and this dispersion is added to an emulsion; a method as disclosed in U.S. Pat. No. 3,822,135 or the like wherein a dye is dissolved in a surfactant and the solution is added to an emulsion; a method as disclosed in J. P. KOKAI No. 51-74624 wherein a dye is dissolved using a compound capable of red shift, and the solution is added to an emulsion; a method as disclosed in J. P. KOKAI No. 50-80826 wherein a dye is dissolved an acid substantially free from water, and the solution is added to an emulsion; or the like may be used. Furthermore, a method for addition to an emulsion disclosed in U.S. Pat. Nos. 2,912,343, 3,342,605, 2,996,287 or 3,429,835, or the like may also be used. Further, the above sensitizing dye may uniformly be dispersed in a silver halide emulsion before it is applied on a suitable support, and may of course be dispersed in any step for preparation of a silver halide emulsion.

That is, the sensitizing dye may be added in any step of preparation of a photographic emulsion, or in any stage from after preparation of the emulsion to just before application thereof. Examples of the former stage are a silver halide grain-forming step, a physical ripening step, a chemical ripening step and the like.

A sensitizing dye of the present invention may be used in an amount sufficient for effectively increasing sensitivity of an emulsion. This amount may widely be changed according to the condition of an emulsion to be used, but may preferably be $1\times10^{-6}$ to $5\times10^{-3}$ mole, preferably $3\times10^{-6}$ to $2.5\times10^{-3}$ mole per mole of the silver halide.

Any silver halide among silver bromide, silver bromoiodide, silver bromochloreiodide, silver bromochloride and silver chloride may be used in the photographic emulsion of the present invention.

Silver halide grains in the photographic emulsion may be so-called regular grains which have a regular crystal shape such as cubic, octahedron or tetradecahedron, grains having an irregular crystal shape such as sphere, or grains having crystal defect such as twinning plane, or grains having a composite shape thereof.

Grain size of the silver halide may be a fine size of 0.1 μm or less, or a large size up to 10 μm in diameter of projected area. Further, an emulsion containing such silver halide may be a monodispersed emulsion having a narrow distribution, or a multi-dispersed emulsion having a wide distribution.

A silver halide photographic emulsion of the present invention can be prepared according to a known method, for example a method disclosed in Research Disclosure, No. 17643 (Dec.. 1978), pages 22 to 23 ("I. Emulsion preparation and types"), or ibid. No. 18716 (Nov., 1979), page 648.

A photographic emulsion of the present invention can also be prepared using a method disclosed in P. Glafkides, Chimie et Physique Photographique, Paul Montel, 1967; G. F. Duffin, Photographic Emulsion Chemistry, Focal Press, 1966; V. L. Zelikman et at.; Making and Coating Photographic Emulsion, Focal Press, 1964, or the like. That is, any of an acidic method, a neutral method, an ammonia method and the like may be utilized, and as for a method for reacting a soluble silver salt with a soluble halogen salt, any of a single-jet method, a simultaneous-jet method and a combination thereof may be utilized. Further, a method wherein grains are formed using excess silver ions (a so-called reverse-jet method) can also be utilized. Further, a method wherein pAg in a liquid phase where a silver halide is formed is held constant, namely a so-called controlled double-jet method can also be used as a mode of a simultaneous-jet method. According to this method, a silver halide emulsion containing grains having a regular crystal shape and an almost uniform size may be obtained.

Further, it is also possible to mix 2 or more kinds of silver halide emulsions which were separately prepared.

A silver halide emulsion comprising the aforementioned regular grains may be obtained by controlling pAg and pH during formation of grains, as is detailedly described, for example in Photographic Science and Engineering, vol. 6, pages 159 to 165 (1962); Journal of Photographic Science, vol. 12, pages 242 to 251 (1964); U.S. Pat. No. 3,655,394 or U.K. Pat. No. 1,413,748.

Typical monodispersed emulsion is such an emulsion that contains silver halide grains which have an average grain size more than about 0.1 μm and at least 95 weight % of which have grain sizes which fall within ±40% of the average grain size. An emulsion which contains silver halide grains which have an average grain size of 0.25 to 2 μm, and at least 95 weight % or at least 95% in number of which have grain sizes which fall within ±20% of the average grain size can also be used in the present invention. Processes for preparation of such as emulsion are disclosed in U.S. Pat. Nos. 3,574,628 and 3,655,394 and U.K. Pat. No. 1,413,748. Monodispersed emulsions disclosed in J. P. KOKAI Nos. 48-8600, 51-39027, 51-83097, 53-137133, 54-48521, 54-99419, 58-37635, 58-49938 and the like can also preferably be used in the present invention.

Further, tabular grains having an aspect ratio of 5 or more can also be used in the present invention. Tabular grains can readily be prepared according to a method disclosed in U.S. Pat. Nos. 4,434,226, 4,414,310, 4,433,048 or 4,439,520, U.K. Pat. No. 2,112,157, or the like. When tabular grains are used, various advantages such as enhancement of spectral sensitization efficiency by a sensitizing dye, enhancement of graininess and increase of sharpness are brought about, which is detailedly described in U.S. Pat. No. 4,434,226 referred to above.

Crystals of silver halide may be composed of a uniform structure, a halogen composition heterogenous between inside and outside, or a layer structure. Such various emulsion grains are disclosed in U.K. Patent No. 1,027,146, U.S. Pat. Nos. 3,505,068 and 4,444,877, J. P. KOKAI No. 60-143331, and the like.

As for halogen distribution in grains, halogen may be either uniformly distributed or distributed with a composition heterogenous between inside and outside, or layers each having a heterogenous halogen composition are superposed. Particularly preferred grains are those having substantially two distinct layer structures (core/shell structure) composed of core part of a higher iodine content and shell part of a lower iodine content.

Further, silver halides mutually having different compositions may be conjugated by epitaxial conjunction, and a silver halide may be conjugated with a compound other than silver halide such as silver rhodanide or lead oxide by epitaxial conjunction. These emulsions grains are disclosed in U.S. Pat. Nos. 4,094,684, 4,142,900 and 4,459,353, U.K. Pat. No. 2,038,792, U.S. Pat. Nos. 4,349,622, 4,395,478, 4,433,501, 4,463,087, 3,656,962 and 3,852,067, J. P. KOKAI No. 59-162540, and the like.

Further, it is possible to use a mixture of grains of various crystal shapes.

An emulsion of the present invention is usually subjected to physical ripening and chemical ripening prior to use. Additives to be used in such steps are disclosed in Research Disclosure Nos. 17643 and 18716, and the relevant parts are summarized in the following table.

Known photographic additives usable in the present invention are also disclosed in the above two Research Disclosure journals, and the relevant parts are summarized in the following table.

| | Kind of additive | RD 17643 | RD 18716 |
|---|---|---|---|
| 1 | Chemically sensitizing agent | page 23 | page 648, right column (r.c.) |
| 2 | Sensitivity-enhancing agent | | " |
| 3 | Spectrally sensitizing agent | pages 23–24 | page 648 r.c.–page 649 r.c. |
| 4 | Antifoggant and stabilizing agent | pages 24–25 | page 649 r.c. |
| 5 | Light-absorbing agent Filter dye and UV absorbent | pages 25–26 | page 649 r.c.–page 650 r.c. |
| 6 | Stain inhibitor | page 25 r.c. | pages 650 left column (l.c.)–r.c. |
| 7 | Hardening agent | page 26 | page 651 l.c. |
| 8 | Binder | page 26 | " |
| 9 | Plasticizer and lubricant | page 27 | page 650 r.c. |
| 10 | Coating aid and surfactant | pages 26–27 | " |
| 11 | Static inhibitor | page 27 | " |

Various color-forming couplers can be used in the present invention, and specific examples thereof are disclosed in patents listed in the above Research Disclosure (RD) No. 17643, VII-C-G. As dye-forming couplers, couplers which respectively give three primary colors (i.e., yellow, magenta and cyan) in subtractive color process by color development are important. Examples of nondiffusible 4- or 2-equivalent couplers preferably used in the present invention include couplers disclosed in patents disclosed in the aforementioned RD No. 17643, VII-C and D items as well as couplers described below.

Typical yellow dye-forming couplers usable in the present invention include hydrophobic acylacetoamide type couplers having a ballast group. Specific examples thereof are disclosed in U.S. Pat. Nos. 2,407,210, 2,875,057 and 3,265,506, and the like. 2-Equivalent yellow dye-forming couplers are preferably used in the present invention, and typical examples thereof include oxygen atom-coupling off type yellow dye-forming couplers disclosed in U.S. Pat. Nos. 3,408,194, 3,447,928, 3,993,501 and 4,022,620, and the like, and nitrogen atom-coupling off type yellow dye-forming couplers disclosed in J. P. KOKOKU No. 58-10739, U.S. Pat. Nos. 4,401,752 and 4,326,024, RD No. 18053 (April, 1979), U.K. Pat. No. 1,425,020, German Patent Unexamined Published APPLICATION (OLS) Nos. 2,219,917, 2,261,361, 2,329,587 and 2,433,812, and the like. α-Pivaloylacetanilide type couplers are excellent in fastness, particularly light fastness of their color dyes, and on the other hand α-benzoylacetanilide type couplers give higher color densities.

Magenta dye-forming couplers usable in the present invention include indazolone type, cyanoacetyl type, 5-pyrazolone type and pyrazoloazole type couplers which respectively have a ballast group and are hydrophobic, and 5-pyrazolone type and pyrazoloazole type couplers are preferable. As 5-pyrazolone type couplers, couplers whose 3-positions are each substituted with an arylamino group or an acylamino group are preferable in view of the hue or color density of their color dyes, and typical examples thereof are disclosed in U.S. Pat. Nos. 2,311,082, 2,343,703, 2,600,788, 2,908,573, 3,062,653, 3,152,896 and 3,936,015, and the like. As a coupling-off group of a 2-equivalent 5-pyrazolone type coupler, a nitrogen atom-coupling off group disclosed in U.S. Pat. No. 4,310,619, or an arylthio group disclosed in U.S. Pat. No. 4,351,897 is particularly preferred. A 5-pyrazolone type coupler having a ballast group as disclosed in European Patent No. 73,636 gives a high color density. As pyrazoloazole type couplers, pyrazolobenzimidazoles disclosed in U.S. Pat. No. 3,369,879, pyrazolo(5,1-c)(1,2,4)triazoles disclosed in U.S. Pat. No. 3,725,067, pyrazolotetrazoles disclosed in Research Disclosure No. 24,220 (June, 1984) and J. P. KOKAI No. 60-33552, and pyrazolopyrazoles disclosed in Research Disclosure No. 24,230 (June, 1984) and J. P. KOKAI No. 60-43659 may preferably be used. In view of reduced yellow subabsorption of a colored dye and light fastness of the colored dye, imidazo(1,2-b)pyrazoles disclosed in U.S. Pat. No. 4,500,630 are preferable, and pyrazolo(1,5-b)(1,2,4)triazole disclosed in European Pat. No. 119,860A is particularly preferable.

Cyan dye-forming couplers usable in the present invention include naphthol type and phenol type couplers which are hydrophobic and nondiffusible. Typical naphthol type couplers include naphthol type couplers disclosed in U.S. Pat. No. 2,474,293, and preferably oxygen atom-coupling off type 2-equivalent naphthol type couplers disclosed in U.S. Pat. Nos. 4,052,212, 4,146,396, 4,228,233 and 4,296,200. Specific examples of phenol type couplers are disclosed in U.S. Pat. Nos. 2,369,929, 2,801,171, 2,772,162 and 2,895,826, and the like. Cyan dye-forming couplers fast against humidity and temperature are preferably used in the present invention, and typical examples thereof include phenol type cyan dye-forming couplers having an alkyl group of an ethyl group and up at the meta position of the phenol nucleus as disclosed in U.S. Pat. No. 3,772,002; 2,5-diacylamino-substituted phenol type couplers disclosed in U.S. Pat. Nos. 2,772,162, 3,758,308, 4,126,396, 4,334,011 and 4,327,173, OLS No. 3,326,729, European Pat. No. 121,365, and the like; phenol type couplers having a phenylureido group at the 2-position and an acylamino group at the 5-position as disclosed in U.S. Pat. Nos. 3,446,622, 4,333,999, 4,451,559 and 4,427,767, and the like; and the like.

In order to correct unnecessary absorption of a colored dye, it is preferable in color light-sensitive materials that masking is carried out by using a colored coupler together. Typical examples of the colored couplers include yellow-colored magenta dye-forming couplers disclosed in U.S. Pat. No. 4,163,670, J.P. KOKOKU No. 57-39413 and the like; magenta-colored cyan dye-forming couplers disclosed in U.S. Pat. Nos. 4,004,929 and 4,138,253, U.K. Pat. No. 1,146,368, and the like; and the like. Other colored couplers are disclosed in the aforementioned RD No. 17643, Items VII-G.

It is possible to improve graininess by using such a coupler that a colored dye derived therefrom has a proper diffusibility.

As such couplers, specific examples of magenta dye-forming couplers are disclosed in U.S. Pat. No. 4,366,237 and U.K. Pat. No. 2,125,570, and specific examples of yellow, magenta or cyan dye-forming couplers are disclosed in European Pat. No. 96,570 and OLS No. 3,234,533.

Dye-forming couplers and the above special couplers may each form polymers of dimer or more. Typical examples of polymerized dye-forming couplers are disclosed in U.S. Pat. Nos. 3,451,820 and 4,080,211. Specific examples of polymerized magenta dye-forming couplers are disclosed in U.K. Patent No. 2,102,173 and U.S. Pat. No. 4,367,282.

Couplers releasing a photographically useful residue together with coupling can also preferably be used in the present invention. As DIR couplers releasing a development inhibitor, couplers disclosed in patents disclosed in the aforementioned RD No. 17643, item VII-F are useful.

Preferred DIR couplers to be used in combination with the present invention include developing solution-inactivating type DIR couplers typically disclosed in J.P. KOKAI No. 57-151944; timing type DIR couplers typically disclosed in U.S. Pat. No. 4,248,962 and J.P. KOKAI No. 57-154234; and reaction type DIR couplers typically disclosed in J.P. KOKAI No. 57-184248. Particularly preferred DIR couplers include developing solution-inactivating type DIR couplers disclosed in J.P. KOKAI Nos. 57-151944, 58-217932, 60-218644, 60-225156 and 60-233650, and the like, and reaction type DIR couplers disclosed in J.P. KOKAI No. 60-184248 and the like.

Examples of suitable supports usable for photographic light-sensitive materials having a photographic emulsion of the present invention include those disclosed, for example in the aforementioned RD No. 17643, page 28 and RD No. 18716, page 647 right column to page 648 left column.

Photographic light-sensitive materials to which a photographic emulsion of the present invention is applicable include various color and black-and-white light-sensitive materials. Examples of such light-sensitive materials include color negative films for photographing (for generic use, movie and the like), reversal color films (for slide, movie and the like; couplers are either included or not included), color photographic pages, color positive films (for movie and the like), reversal color photographic papers, color light-sensitive materials for heat development, color light-sensitive materials by use of a silver dye bleaching method, photographic light-sensitive materials for making printing plates (litho-film, scanner film and the like), X-ray photographic light-sensitive materials (for direct or indirect medical use, industrial use, and the like), black-and-white negative films for photographing, black-and-white photographic papers, light-sensitive materials for micro-use (for COM, microfilm and the like), color diffusion transfer light-sensitive materials (DTR), silver salt diffusion transfer light-sensitive materials, print-out light-sensitive materials, and the like.

Exposure to light for obtaining a photographic image by a photographic light-sensitive material using a photographic emulsion of the present invention may be carried out using an usual method. That is, any of various known light sources containing infrared light such as natural light (sunlight), a tungsten lamp, a fluorescent lamp, a mercury lamp, a xenon are lamp, a carbon arc lamp, a xenon flash lamp, cathode ray tube flying spot, luminescent diode, laser light (e.g., gas laser, YAG laser, dye laser, semiconductor laser and the like), and the like. Exposure to light may also be carried out by light emitted from a fluorescent material excited with electron beams, X-rays, γ-rays, α-rays or the like. Exposure time may first be 1/1000 to one second used in an ordinal camera, may also be a time shorter than 1/1000 second, for example $1/10^4$ to $1/10^6$ second in case of using a xenon flash lamp or a cathode ray tube, and may further be a time longer than one second. It is possible, according to necessity, to adjust spectral composition of light used in exposure using a color filter.

A photographic light-sensitive material to which a photographic emulsion of the present invention is applicable can be developed according to a usual method disclosed in the aforementioned RD No. 17643, pages 28 to 29, or RD No. 18716, page 651 left to right column.

Examples of the present invention are demonstrated below, but the present invention should not be interpreted as limited only to these examples.

EXAMPLE 1

Silver halide grains were formed by a double-jet method, successively followed by physical ripening process, desalting process and chemical ripening process to obtain a silver iodobromide (containing 7.5 mole % iodine) emulsion. The average size (diameter) of silver halide grains contained in this emulsion was 0.8 μm. Further, 0.55 mol of silver halide was contained in 1 kg of this emulsion.

One kilogram of the emulsion was placed in a pot and dissolved with heating to 40° C. Each of methanol solutions of sensitizing dyes listed in Table 1 was added thereto, and the mixture was stirred. Then, 10 ml of an aqueous 1.0 weight % 4-hydroxy-6-methyl-1,3,3a,7-tetrazaindene solution, 10 ml of an aqueous 1.0 weight % 1-hydroxy-3,5-dichlorotriazine sodium salt solution, and 10 ml of an aqueous 1.0 weight % sodium dodecylbenzenesulfonate solution were successively added thereto, followed by stirring. This complete emulsion was applied onto a cellulose triacetate film base to a dried film thickness of 5 μm, and dried to obtain samples 101 to 123.

Each of these film samples was subjected to wedge exposure using a sensitometer having a light source of color temperature of 4800° K., which was accompanied with a yellow filter (SC-50 manufactured by Fuji Photo Film Co., Ltd.).

After exposure to light, each of the film samples was developed at 20° C. for 7 minutes using a developing solution having the following composition, subjected successively to stop and fixing processes, and then washed with water to obtain a strip having a black-and-white image. This strip was subjected to density measurement using a P type densitometer manufactured by Fuji Photo Film Co., Ltd. to obtain sensitivity and fog. Reference point of optical density for determination of sensitivity was point of (fog+0.20).

| Composition of the developing solution | |
|---|---|
| Water | 700 ml |
| Metol | 2.0 g |
| Anhydrous sodium sulfite | 100.0 g |
| Hydroquinone | 5.0 g |
| Borax pentahydrate | 1.5 g |
| Water to | 1 l |

Results are shown in Table 1 using the fogging value and sensitivity value of sample 101 of fresh performance (i.e., immediately after preparation of the sample), respectively as a standard. Further, samples 101 to 123 were, after preservation for 3 days at 50° C. with 80% RH, similarly exposed to light and developed, and fog and sensitivity were determined. The results are shown in Table 1.

Sensitizing dyes used in comparative examples are as follows.

SD-1

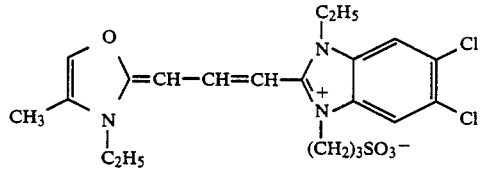

SD-2

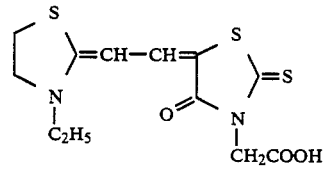

SD-3

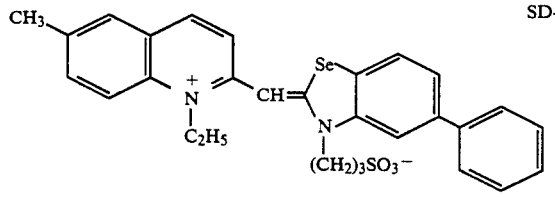

TABLE 1

| Sample No. | Sensitizing dye A | Sensitizing dye B | Sensitizing dye C | Fresh performance Fog | Fresh performance Relative sensitivity | After preservation for 3 days (50° C., 80% RH) Fog | After preservation for 3 days (50° C., 80% RH) Relative sensitivity |
|---|---|---|---|---|---|---|---|
| 101 (Present invention) | I-5 $3.2 \times 10^{-4}$ mol/mol Ag | II-1 $1.6 \times 10^{-4}$ mol/mol Ag | — | ±0 (Standard of fog) | 100 (Standard of sensitivity) | +0.01 | 98 |
| 102 (Present invention) | I-7 $3.2 \times 10^{-4}$ mol/mol Ag | II-1 $1.6 \times 10^{-4}$ mol/mol Ag | — | −0.01 | 97 | +0.01 | 94 |
| 103 (Present invention) | I-5 $3.2 \times 10^{-4}$ mol/mol Ag | II-2 $1.6 \times 10^{-4}$ mol/mol Ag | — | +0.02 | 99 | +0.04 | 97 |
| 104 (Present invention) | I-7 $3.2 \times 10^{-4}$ mol/mol Ag | II-2 $1.6 \times 10^{-4}$ mol/mol Ag | — | +0.01 | 101 | +0.02 | 99 |
| 105 (Comparative example) | SD-1 $3.2 \times 10^{-4}$ mol/mol Ag | II-1 $1.6 \times 10^{-4}$ mol/mol Ag | — | +0.09 | 104 | +0.18 | 88 |

TABLE 1-continued

| Sample No. | Sensitizing dye A | Sensitizing dye B | Sensitizing dye C | Fresh performance Fog | Fresh performance Relative sensitivity | After preservation for 3 days (50° C., 80% RH) Fog | After preservation for 3 days (50° C., 80% RH) Relative sensitivity |
|---|---|---|---|---|---|---|---|
| 106 (Comparative example) | SD-2 $3.2 \times 10^{-4}$ mol/mol Ag | II-1 $1.6 \times 10^{-4}$ mol/mol Ag | — | +0.15 | 95 | +0.27 | 62 |
| 107 (Comparative example) | SD-3 $3.2 \times 10^{-4}$ mol/mol Ag | II-1 $1.6 \times 10^{-4}$ mol/mol Ag | — | +0.06 | 90 | +0.13 | 65 |
| 108 (Comparative example) | SD-1 $3.2 \times 10^{-4}$ mol/mol Ag | II-2 $1.6 \times 10^{-4}$ mol/mol Ag | — | +0.11 | 103 | +0.19 | 89 |
| 109 (Comparative example) | SD-2 $3.2 \times 10^{-4}$ mol/mol Ag | II-2 $1.6 \times 10^{-4}$ mol/mol Ag | — | +0.21 | 93 | +0.31 | 60 |
| 110 (Comparative example) | SD-3 $3.2 \times 10^{-4}$ mol/mol Ag | II-2 $1.6 \times 10^{-4}$ mol/mol Ag | — | +0.08 | 91 | +0.14 | 64 |
| 111 (Present invention) | I-5 $2.0 \times 10^{-4}$ mol/mol Ag | II-1 $1.6 \times 10^{-4}$ mol/mol Ag | III-2 $1.2 \times 10^{-4}$ mol/mol Ag | ±0 (Standard of fog) | 100 (Standard of sensitivity) | +0.02 | 97 |
| 112 (Present invention) | I-7 $2.0 \times 10^{-4}$ mol/mol Ag | II-1 $1.6 \times 10^{-4}$ mol/mol Ag | III-2 $1.2 \times 10^{-4}$ mol/mol Ag | −0.02 | 98 | 0.00 | 95 |
| 113 (Present invention) | I-5 $2.0 \times 10^{-4}$ mol/mol Ag | II-2 $1.6 \times 10^{-4}$ mol/mol Ag | III-2 $1.2 \times 10^{-4}$ mol/mol Ag | +0.02 | 102 | +0.03 | 97 |
| 114 (Present invention) | I-7 $2.0 \times 10^{-4}$ mol/mol Ag | II-1 $1.6 \times 10^{-4}$ mol/mol Ag | III-2 $1.2 \times 10^{-4}$ mol/mol Ag | +0.00 | 102 | +0.02 | 98 |
| 115 (Present invention) | I-7 $2.0 \times 10^{-4}$ mol/mol Ag | — — | III-2 $2.8 \times 10^{-4}$ mol/mol Ag | +0.01 | 97 | +0.03 | 95 |
| 116 (Comparative example) | SD-1 $2.0 \times 10^{-4}$ mol/mol Ag | II-1 $1.6 \times 10^{-4}$ mol/mol Ag | III-2 $1.2 \times 10^{-4}$ mol/mol Ag | +0.10 | 106 | +0.19 | 89 |
| 117 (Comparative example) | SD-2 $2.0 \times 10^{-4}$ mol/mol Ag | II-1 $1.6 \times 10^{-4}$ mol/mol Ag | III-2 $1.2 \times 10^{-4}$ mol/mol Ag | +0.17 | 98 | +0.29 | 64 |
| 118 (Comparative example) | SD-3 $2.0 \times 10^{-4}$ mol/mol Ag | II-1 $1.6 \times 10^{-4}$ mol/mol Ag | III-2 $1.2 \times 10^{-4}$ mol/mol Ag | +0.08 | 92 | +0.15 | 66 |
| 119 (Comparative example) | SD-1 $2.0 \times 10^{-4}$ mol/mol Ag | II-2 $1.6 \times 10^{-4}$ mol/mol Ag | III-2 $1.2 \times 10^{-4}$ mol/mol Ag | +0.14 | 103 | +0.21 | 91 |
| 120 (Comparative example) | SD-2 $2.0 \times 10^{-4}$ mol/mol Ag | II-2 $1.6 \times 10^{-4}$ mol/mol Ag | III-2 $1.2 \times 10^{-4}$ mol/mol Ag | +0.26 | 93 | +0.33 | 62 |
| 121 (Comparative example) | SD-3 $2.0 \times 10^{-4}$ mol/mol Ag | II-2 $1.6 \times 10^{-4}$ mol/mol Ag | III-2 $1.2 \times 10^{-4}$ mol/mol Ag | +0.11 | 92 | +0.17 | 66 |
| 122 (Comparative example) | — — | II-1 $2.6 \times 10^{-4}$ mol/mol Ag | III-2 $2.2 \times 10^{-4}$ mol/mol Ag | −0.01 | 89 | +0.02 | 86 |
| 123 (Comparative example) | — — | II-2 $2.6 \times 10^{-4}$ mol/mol Ag | III-2 $2.2 \times 10^{-4}$ mol/mol Ag | −0.01 | 86 | +0.03 | 83 |

EXAMPLE 2

A silver halide emulsion layer and a gelatin protective layer each having the following compositions were applied on a cellulose triacetate film support which had been provided with an undercoat to prepare samples 201 to 223.

(Light-sensitive layer composition)

Figure corresponding to each component means a coated amount represented by a unit of g/m$^2$, and means a coated amount in terms of silver amount for silver halide. However, as for each of the sensitizing dyes, figure corresponding thereto means a coated amount represented by moles per 1 mole of the silver halide in the same layer.

| | |
|---|---|
| (Emulsion layer) | |
| Silver iodobromide emulsion<br>6 mole % silver iodide, variation coefficient of grain size (S/F) = 0.18, Aspect ratio 6.0, Average grain size (F) = 0.18 μm | 2.0 |
| Gelatin | 1.0 |
| Sensitizing dye (disclosed in Table 2) | |
| Cpd-5 | 0.25 |

-continued
| | |
|---|---|
| Cpd-15 | 0.25 |
| Cpd-8 | 0.03 |
| Cpd-7 | 0.05 |
| Oil-1 | 0.50 |
| Oil-4 | 0.13 |
| (Protective layer) | |
| Gelatin | 0.50 |
| Hardening agent H-1 | 0.40 |
| Cpd-7 | 0.05 |
| Oil-1 | 0.50 |
| Oil-4 | 0.13 |
| (Protective layer) | |
| Gelatin | 0.50 |
| Hardening agent H-1 | 0.40 |
Cpd-5
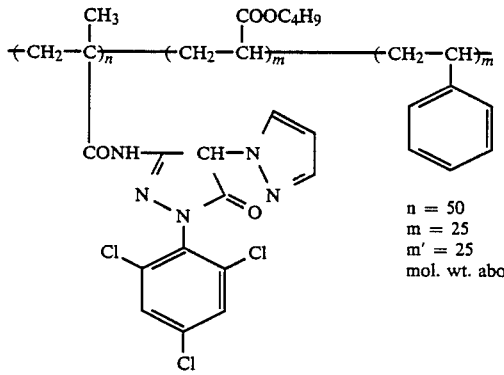
n = 50
m = 25
m' = 25
mol. wt. about 20,000
Cpd-7
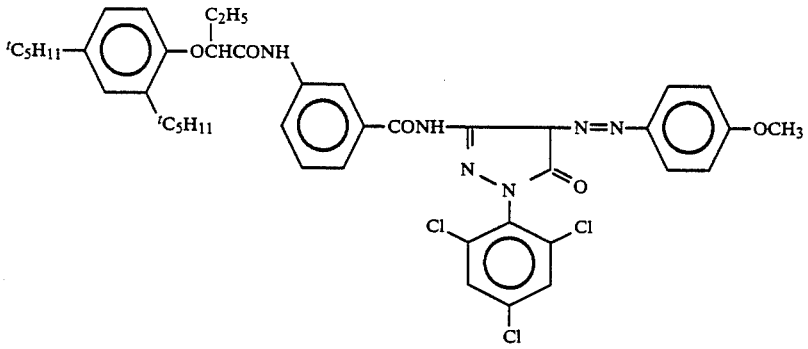
Cpd-8
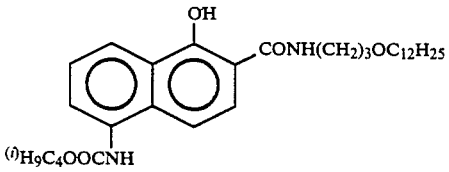

-continued
Cpd-15
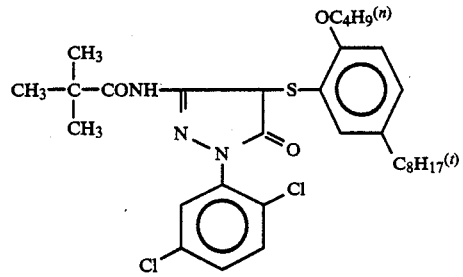
oil-1 Tricresyl phosphate
Oil-4
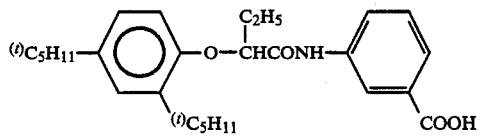
Hardening agent H-1
$CH_2{=}CHSO_2CH_2CONHCH_2$
$\quad\quad\quad TABLE 2-continued

| Sample No. | Sensitizing dye A | Sensitizing dye B | Sensitizing dye C | Fresh performance Fog | Fresh performance Relative sensitivity | After preservation for 3 days (50° C., 80% RH) Fog | After preservation for 3 days (50° C., 80% RH) Relative sensitivity |
|---|---|---|---|---|---|---|---|
| (Present invention) | mol/mol Ag | mol/mol Ag | | | | | |
| 204 (Present invention) | I-7 $3.5 \times 10^{-4}$ mol/mol Ag | II-2 $1.5 \times 10^{-4}$ mol/mol Ag | — | +0.02 | 103 | +0.04 | 98 |
| 205 (Comparative example) | SD-1 $3.5 \times 10^{-4}$ mol/mol Ag | II-1 $1.5 \times 10^{-4}$ mol/mol Ag | — | +0.11 | 105 | +0.20 | 86 |
| 206 (Comparative example) | SD-2 $3.5 \times 10^{-4}$ mol/mol Ag | II-1 $1.5 \times 10^{-4}$ mol/mol Ag | — | +0.21 | 97 | +0.38 | 60 |
| 207 (Comparative example) | SD-3 $3.5 \times 10^{-4}$ mol/mol Ag | II-1 $1.5 \times 10^{-4}$ mol/mol Ag | — | +0.09 | 93 | +0.17 | 61 |
| 208 (Comparative example) | SD-1 $3.5 \times 10^{-4}$ mol/mol Ag | II-2 $1.5 \times 10^{-4}$ mol/mol Ag | — | +0.17 | 102 | +0.23 | 87 |
| 209 (Comparative example) | SD-2 $3.5 \times 10^{-4}$ mol/mol Ag | II-2 $1.5 \times 10^{-4}$ mol/mol Ag | — | +0.29 | 94 | +0.40 | 57 |
| 210 (Comparative example) | SD-3 $3.5 \times 10^{-4}$ mol/mol Ag | II-2 $1.5 \times 10^{-4}$ mol/mol Ag | — | +0.13 | 92 | +0.26 | 62 |
| 211 (Present invention) | I-5 $2.5 \times 10^{-4}$ mol/mol Ag | II-1 $1.5 \times 10^{-4}$ mol/mol Ag | III-2 $1.0 \times 10^{-4}$ mol/mol Ag | ±0 (Standard of fog) | 100 (Standard of sensitivity | +0.03 | 96 |
| 212 (Present invention) | I-7 $2.5 \times 10^{-4}$ mol/mol Ag | II-1 $1.5 \times 10^{-4}$ mol/mol Ag | III-2 $1.0 \times 10^{-4}$ mol/mol Ag | −0.01 | 99 | +0.01 | 95 |
| 213 (Present invention) | I-5 $2.5 \times 10^{-4}$ mol/mol Ag | II-2 $1.5 \times 10^{-4}$ mol/mol Ag | III-2 $1.0 \times 10^{-4}$ mol/mol Ag | +0.03 | 103 | +0.05 | 98 |
| 214 (Present invention) | I-7 $2.5 \times 10^{-4}$ mol/mol Ag | II-2 $1.5 \times 10^{-4}$ mol/mol Ag | III-2 $1.0 \times 10^{-4}$ mol/mol Ag | +0.02 | 102 | +0.04 | 98 |
| 215 (Present invention) | I-7 $2.5 \times 10^{-4}$ mol/mol Ag | — — mol/mol Ag | III-2 $2.5 \times 10^{-4}$ mol/mol Ag | +0.02 | 96 | +0.04 | 93 |
| 216 (Relative example) | SD-1 $2.5 \times 10^{-4}$ mol/mol Ag | II-1 $1.5 \times 10^{-4}$ mol/mol Ag | III-2 $1.0 \times 10^{-4}$ mol/mol Ag | +0.15 | 108 | +0.23 | 88 |
| 217 (Relative example) | SD-2 $2.5 \times 10^{-4}$ mol/mol Ag | II-1 $1.5 \times 10^{-4}$ mol/mol Ag | III-2 $1.0 \times 10^{-4}$ mol/mol Ag | +0.22 | 99 | +0.36 | 60 |
| 218 (Relative example) | SD-3 $2.5 \times 10^{-4}$ mol/mol Ag | II-1 $1.5 \times 10^{-4}$ mol/mol Ag | III-2 $1.0 \times 10^{-4}$ mol/mol Ag | +0.12 | 93 | +0.18 | 61 |
| 219 (Relative example) | SD-1 $2.5 \times 10^{-4}$ mol/mol Ag | II-2 $1.5 \times 10^{-4}$ mol/mol Ag | III-2 $1.0 \times 10^{-4}$ mol/mol Ag | +0.19 | 105 | +0.27 | 87 |
| 220 (Relative example) | SD-2 $2.5 \times 10^{-4}$ mol/mol Ag | II-2 $1.5 \times 10^{-4}$ mol/mol Ag | III-2 $1.0 \times 10^{-4}$ mol/mol Ag | +0.31 | 94 | +0.43 | 55 |
| 221 (Relative example) | SD-3 $2.5 \times 10^{-4}$ mol/mol Ag | II-2 $1.5 \times 10^{-4}$ mol/mol Ag | III-2 $1.0 \times 10^{-4}$ mol/mol Ag | +0.17 | 92 | +0.23 | 62 |
| 222 (Relative example) | — — | II-1 $3.0 \times 10^{-4}$ mol/mol Ag | III-2 $2.0 \times 10^{-4}$ mol/mol Ag | 0.00 | 87 | +0.02 | 83 |
| 223 (Relative example) | — — | II-2 $3.0 \times 10^{-4}$ mol/mol Ag | III-2 $2.0 \times 10^{-4}$ mol/mol Ag | −0.01 | 86 | +0.02 | 83 |

EXAMPLE 3

Preparation of sample 301

Malti-layered color light-sensitive material, which is herein referred to as sample 301, was prepared by providing each of the layers having the following compositions on a cellulose triacetate film support which had been undercoated.

(Composition of light-sensitive layer)

Coated amounts mean an amount represented by a unit of $g/m^2$ in terms of silver for silver halide and colloidal silver, an amount represented by a unit of $g/m^2$ for couplers, additives and gelatin, and moles per 1 mole of the silver halide in the same layer for each of the sensitizing dyes.

The 1st layer (Antihalation layer)

-continued

| | |
|---|---|
| Black colloidal silver | 0.2 |
| Gelatin | 1.3 |
| Colored coupler Cpd-7 | 0.06 |
| UV absorber UV-1 | 0.1 |
| UV absorber UV-2 | 0.2 |
| Dispersion oil Oil-1 | 0.01 |
| Dispersion oil Oil-2 | 0.01 |
| The 2nd layer (Intermediate layer) | |
| Fine grain silver bromide (Average grain size 0.07 μm) | 0.15 |
| Gelatin | 1 |
| Colored coupler Cpd-27 | 0.02 |
| Dispersion oil Oil-1 | 0.1 |
| The 3rd layer (The 1st red-sensitive emulsion layer) | |
| Silver iodobromide emulsion 4 mole % silver iodide, variation coefficient of grain size (S/γ) = 0.12, Average grain size (γ) = 0.7 μm (hereinafter is referred to as I⁻ 4 moles, S/γ = 0.12, 0.7 μm | 0.6 (g/m²) or less 0.6) |
| Silver iodobromide emulsion I⁻ 3 moles, S/γ = 0.11, 0.3μ | 0.3 |
| Gelatin | 0.6 |
| SD-4 | $4 \times 10^{-4}$ |
| SD-5 | $4 \times 10^{-5}$ |
| Cpd-9 | 0.010 |
| Cpd-10 | 0.010 |
| Cpd-21 | 0.50 |
| Cpd-27 | 0.04 |
| Oil-1 | 0.15 |
| Oil-3 | 0.02 |
| The 4th layer (The 2nd red-sensitive emulsion layer) | |
| Silver iodobromide emulsion I⁻ 6 moles, S/γ = 0.15, 1.0 μm | 0.7 |
| Gelatin | 1.0 |
| SD-4 | $4 \times 10^{-4}$ |
| SD-5 | $5 \times 10^{-5}$ |
| Cpd-24 | 0.1 |
| Cpd-28 | 0.1 |
| Oil-1 | 0.01 |
| Oil-3 | 0.05 |
| The 5th layer (Intermediate layer) | |
| Gelatin | 0.5 |
| Cpd-6 | 0.10 |
| Oil-1 | 0.05 |
| The 6th layer (The 1st green-sensitive emulsion layer) | |
| Silver iodobromide emulsion I⁻ 4 moles, S/γ = 0.11, 0.6 μm | 0.35 |
| Silver iodobromide emulsion I⁻ 3 moles, S/γ = 0.15, 0.3 μm | 0.20 |
| Gelatin | 1.0 |
| I-7 | $5 \times 10^{-4}$ |
| II-2 | $1 \times 10^{-4}$ |
| Cpd-5 | 0.3 |
| Cpd-7 | 0.07 |
| Cpd-13 | 0.03 |
| Oil-1 | 0.3 |
| Oil-4 | 0.1 |
| The 7th layer (The 2nd green-sensitive emulsion layer) | |
| Silver iodobromide emulsion I⁻ 6 moles, S/γ = 0.18, 0.8 μm | 0.8 |
| Gelatin | 0.5 |
| I-7 | $5 \times 10^{-4}$ |
| II-2 | $1 \times 10^{-4}$ |
| Cpd-5 | 0.1 |

-continued

| | |
|---|---|
| Cpd-15 | 0.1 |
| Cpd-8 | 0.01 |
| CPd-7 | 0.02 |
| Oil-1 | 0.2 |
| Oil-4 | 0.05 |
| The 8th layer (Intermediate layer) | |
| Gelatin | 0.5 |
| Cpd-6 | 0.05 |
| Oil-1 | 0.03 |
| The 9th layer (Interlayer effect donor layer) | |
| Silver iodobromide emulsion 2 mole % silver iodide, aspect ratio 6.0, tabular grains having a average grain size of 1.0 μm (hereinafter referred to as I⁻ 2 moles, A/R = 6.0, 1.0 μm | 0.35 g/m² or less 0.35) |
| Silver iodobromide emulsion I⁻ 2 moles, A/R = 6.5, 0.5 μm | 0.20 |
| Gelatin | 0.7 |
| I-7 | $8 \times 10^{-4}$ |
| Cpd-3 | 0.18 |
| Cpd-4 | 0.05 |
| CPd-5 | 0.13 |
| Oil-1 | 0.20 |
| The 10th layer (yellow filter layer) | |
| Gelatin | 0.5 |
| Cpd-2 | 0.25 |
| Cpd-6 | 0.10 |
| The 11th layer (The 1st blue-sensitive emulsion layer) | |
| Silver iodobromide emulsion I⁻ 3 moles, A/R = 7.5, 1.0 μm | 0.3 |
| Silver iodobromide emulsion I⁻ 3 moles, A/R = 7.5, 0.5 μm | 0.15 |
| SD-6 | $2 \times 10^{-4}$ |
| Cpd-1 | 0.05 |
| Cpd-8 | 0.10 |
| Cpd-29 | 0.80 |
| Oil-1 | 0.20 |
| The 12th layer (The 2nd blue-sensitive emulsion layer) | |
| Silver iodobromide emulsion I⁻ 10 moles, S/γ = 0.11, 1.2 μm | 0.5 |
| Gelatin | 0.5 |
| SD-6 | $1 \times 10^{-4}$ |
| Cpd-29 | 0.20 |
| CPd-3 | 0.02 |
| Oil-1 | 0.10 |
| The 13th layer (The 1st protective layer) | |
| Gelatin | 0.8 |
| UV-1 | 0.1 |
| UV-2 | 0.2 |
| Oil-1 | 0.01 |
| Oil-2 | 0.01 |
| The 14th layer (The 2nd protective layer) | |
| Fine grain silver bromide emulsion I⁻ 2 moles, S/γ = 0.2, 0.07 μm | 0.5 |
| Polymethyl methacrylate Grain diameter 1.5 μm | 0.2 |
| Hardening agent H-1 | 0.4 |
| Formaldehyde scavenger S-1 | 0.5 |
| Formaldehyde scavenger S-2 | 0.5 |

Stabilizing agent for emulsion Cpd-26 and a surfactant was further added as coating aids to each of the above layers besides the above components.

Cpd-1
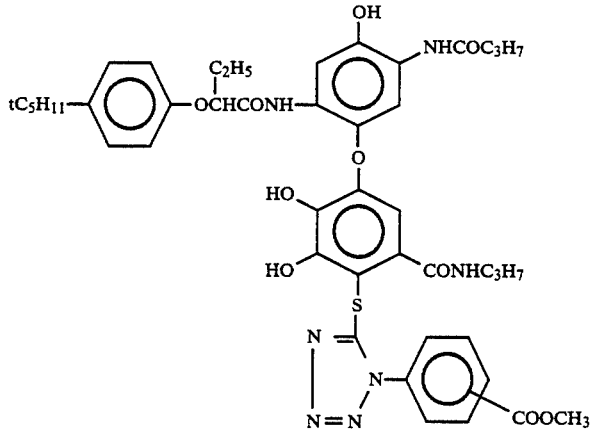
Cpd-2
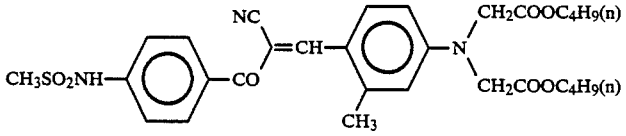
Cpd-3
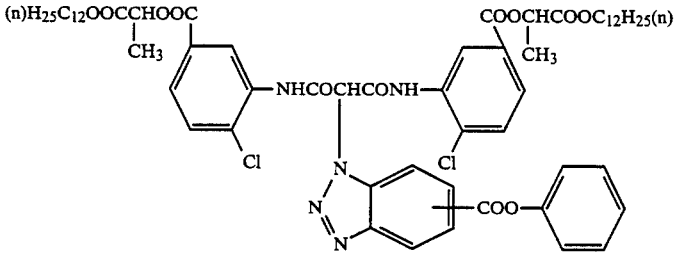
Cpd-4
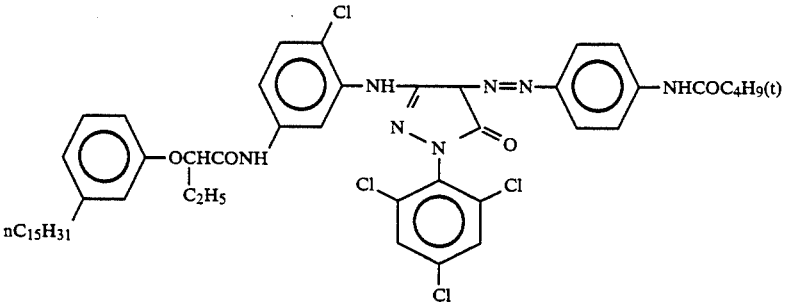
Cpd-6
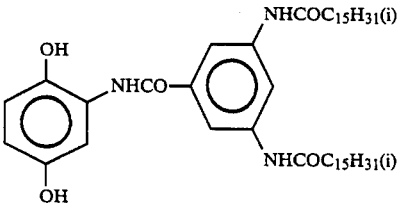
Cpd-9
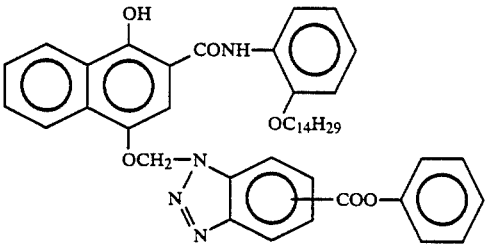

-continued
Cpd-10
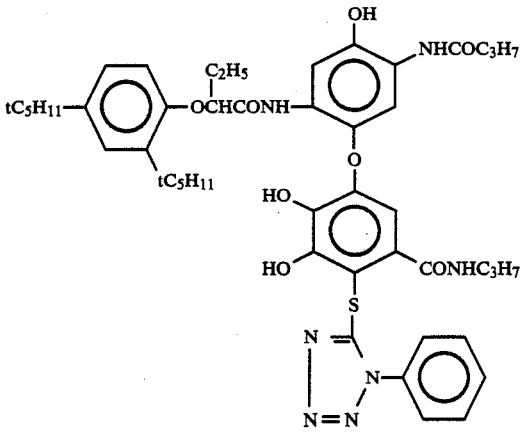
Cpd-11
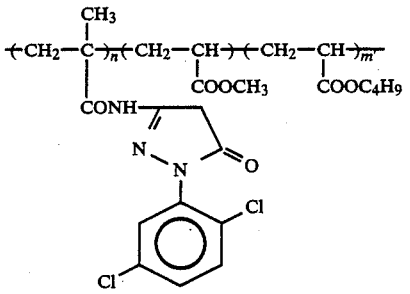
n/m + m' = 1
m/m' = 1 (weight ratio)
mω about 40,000
Cpd-12
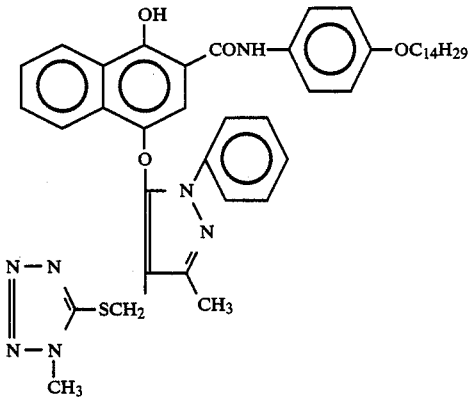
Cpd-13
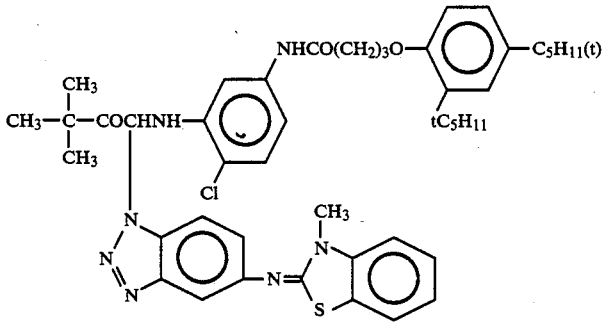

-continued
Cpd-14
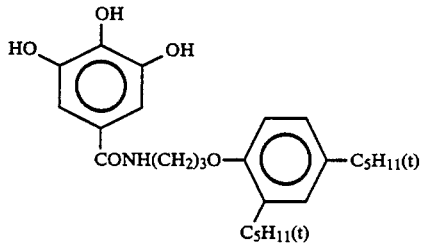
Cpd-16
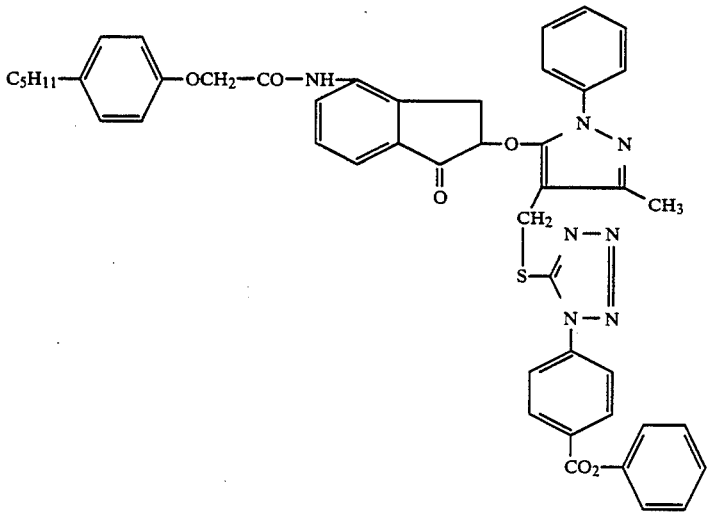
Cpd-17
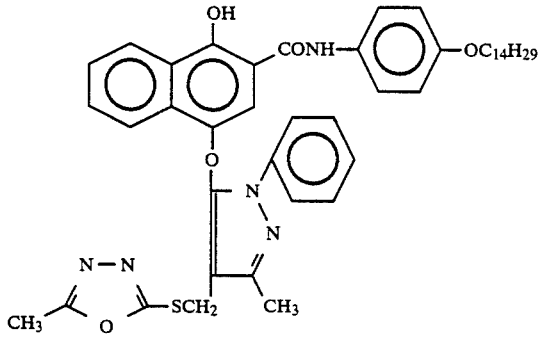
Cpd-18
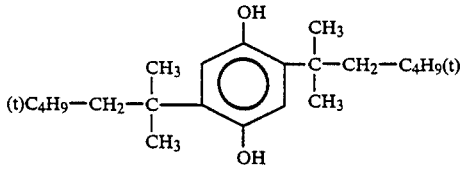
Cpd-19
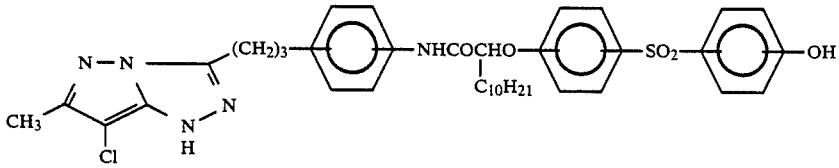

-continued
Cpd-20
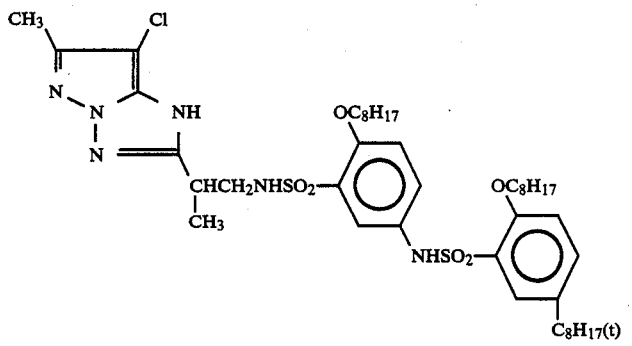
Cpd-21
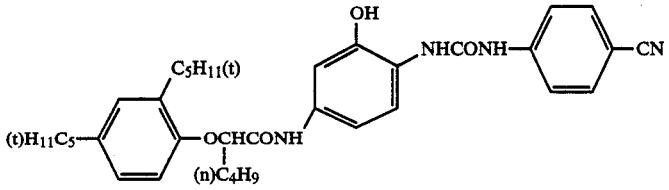
Cpd-22
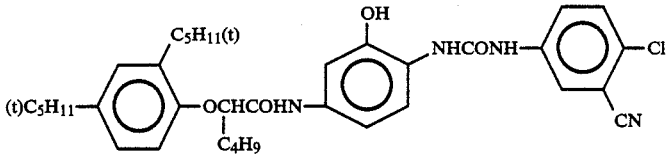
Cpd-23
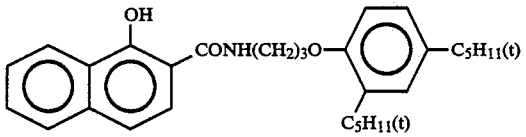
Cpd-24
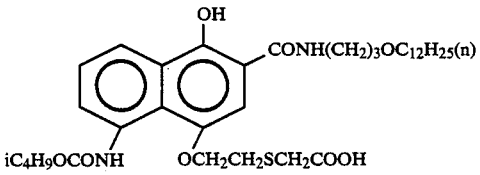
Cpd-25
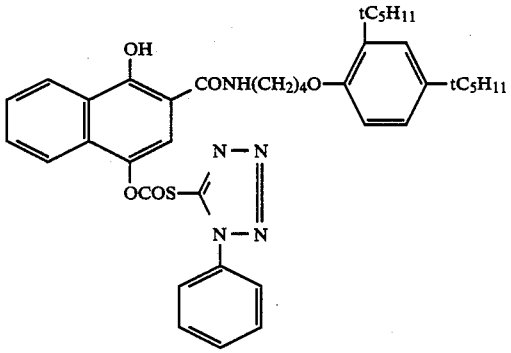
Cpd-26
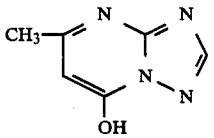

-continued
Cpd-27
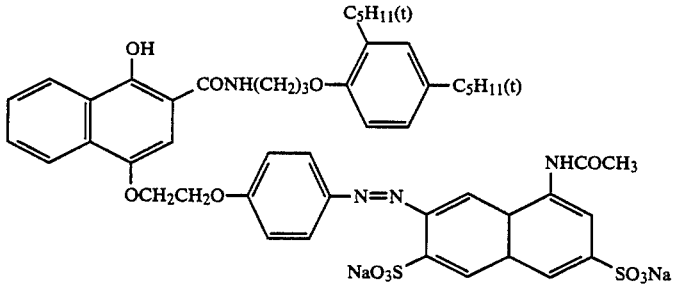
Cpd-28
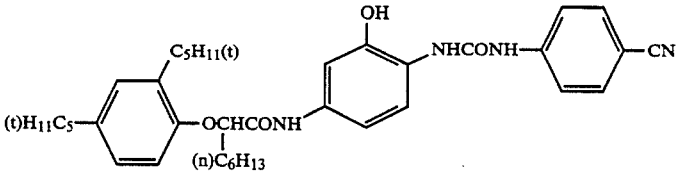
Cpd-29
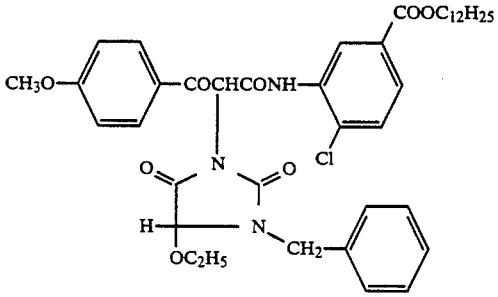
SD-4
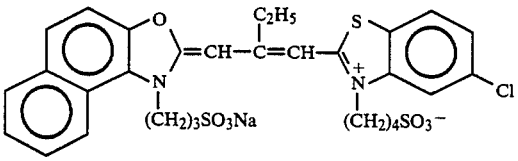
SD-5
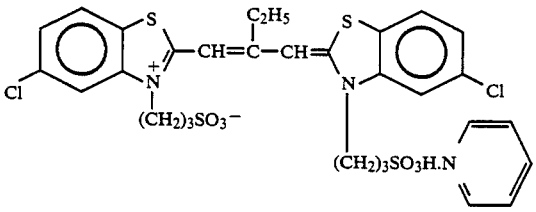
SD-6
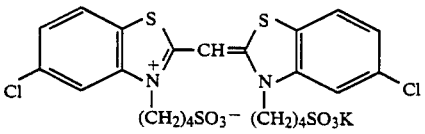
SD-7
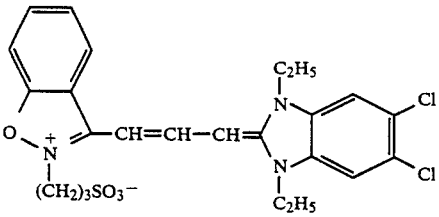

-continued

SD-8

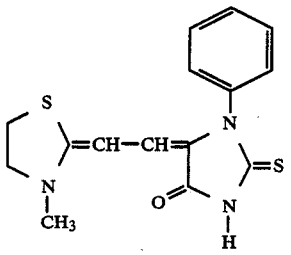

UV-1

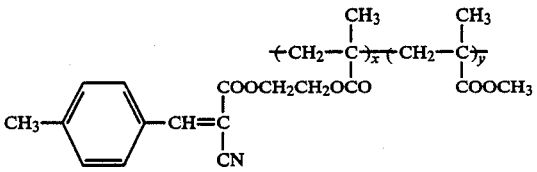

x/y = 7/3 (weight ratio)

UV-2

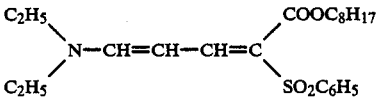

Oil-2 Dibutyl phthalate
Oil-3 Bis(2-ethylhexyl)phthalate

S-1

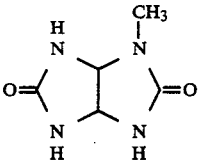

The thus prepared sample was named sample 301. Samples 302 to 314 were each prepared in the same manner as that for preparation of sample 301 using the same composition with sample 301 except of changing the sensitizing dyes for those listed in Table 3.

Each of these photographic elements was exposed to light with an exposure amount of 25 CMS using a tungsten light source whose color temperature had been adjusted to 4800° K. Then, each element was subjected to developing process according to the same steps as in Example 2 except that color development time was made to be 3 minutes and 15 seconds.

The results are shown in Table 3 using fog value and sensitivity value of fresh performance (immediately after preparation of samples) as standard, respectively. Further, each of samples 301 to 314 was preserved for 3 days at 50° C. under 80% RH, and then similarly, exposed to light, developed and measured for fog and sensitivity. The results are also shown in Table 3.

TABLE 3

| Sample No. | The 6th layer sensitizing dye | | | | The 7th layer sensitizing dye | | | | The 9th layer sensitizing dye | | Fresh performance | | After preservation for 3 days (50° C., 80% RH) | |
|---|---|---|---|---|---|---|---|---|---|---|---|---|---|---|
| | Species | Amount mol/mol Ag | Species | Amount mol/mol Ag | Species | Amount mol/mol Ag | Species | Amount mol/mol Ag | Species | Amount mol/mol Ag | Fog | Relative sensitivity | Fog | Relative sensitivity |
| 301 (Present invention) | I-7 | $5 \times 10^{-4}$ | II-2 | $1 \times 10^{-4}$ | I-7 | $5 \times 10^{-4}$ | II-2 | $1 \times 10^{-4}$ | I-7 | $8 \times 10^{-4}$ | ±0 (standard of fog) | 100 (standard of sensitivity) | +0.02 | 95 |
| 302 (Present invention) | " | " | " | " | " | " | " | " | I-19 | $8 \times 10^{-4}$ | −0.01 | 99 | +0.01 | 94 |
| 303 (Present invention) | I-19 | $5 \times 10^{-4}$ | " | " | I-19 | $5 \times 10^{-4}$ | " | " | I-7 | $8 \times 10^{-4}$ | −0.01 | 98 | +0.02 | 92 |
| 304 (Present invention) | I-5 | $5 \times 10^{-4}$ | " | " | I-5 | $5 \times 10^{-4}$ | " | " | " | " | +0.01 | 101 | +0.02 | 95 |
| 305 (Comparative example) | I-7 | $5 \times 10^{-4}$ | " | " | I-7 | $5 \times 10^{-4}$ | " | " | SD-1 | $8 \times 10^{-4}$ | +0.10 | 102 | +0.25 | 78 |
| 306 (Comparative example) | " | " | " | " | " | " | " | " | SD-7 | $8 \times 10^{-4}$ | +0.05 | 86 | +0.08 | 68 |
| 307 (Comparative example) | " | " | " | " | " | " | " | " | SD-2 | $8 \times 10^{-4}$ | +0.12 | 98 | +0.40 | 70 |
| 308 (Comparative example) | " | " | " | " | " | " | " | " | SD-8 | $8 \times 10^{-4}$ | +0.04 | 90 | +0.08 | 72 |
| 309 (Comparative example) | " | " | " | " | " | " | " | " | SD-3 | $8 \times 10^{-4}$ | +0.02 | 88 | +0.07 | 69 |
| 310 (Comparative example) | SD-1 | $5 \times 10^{-4}$ | II-2 | $1 \times 10^{-4}$ | SD-1 | $5 \times 10^{-4}$ | II-2 | $1 \times 10^{-4}$ | I-7 | $8 \times 10^{-4}$ | +0.14 | 103 | +0.30 | 80 |
| 311 (Comparative example) | SD-7 | $5 \times 10^{-4}$ | " | " | SD-7 | $5 \times 10^{-4}$ | " | " | " | " | +0.07 | 88 | +0.10 | 67 |
| 312 (Comparative example) | SD-2 | $5 \times 10^{-4}$ | " | " | SD-2 | $5 \times 10^{-4}$ | " | " | " | " | +0.16 | 95 | +0.46 | 63 |
| 313 | SD-8 | $5 \times 10^{-4}$ | " | " | SD-8 | $5 \times 10^{-4}$ | " | " | " | " | +0.07 | 89 | +0.12 | 70 |

TABLE 3-continued

| Sample No. | The 6th layer sensitizing dye | | | | The 7th layer sensitizing dye | | | | The 9th layer sensitizing dye | | Fresh performance | | After preservation for 3 days (50° C., 80% RH) | |
|---|---|---|---|---|---|---|---|---|---|---|---|---|---|---|
| | Species | Amount mol/mol Ag | Species | Amount mol/mol Ag | Species | Amount mol/mol Ag | Species | Amount mol/mol Ag | Species | Amount mol/mol Ag | Fog | Relative sensitivity | Fog | Relative sensitivity |
| (Comparative example) 314 (Comparative example) | SD-3 | $5 \times 10^{-4}$ | " | " | SD-3 | $5 \times 10^{-4}$ | " | " | " | " | +0.03 | 85 | +0.09 | 63 |

EXAMPLE 4

Samples 301 to 314 of Example 3 were evaluated in the same experimental condition as in Example 3 except that the process steps were changed for those shown below, and almost the same results as therein were obtained.

| Step | Process time | Process temperature |
|---|---|---|
| Color development | 3 min. and 15 sec. | 38° C. |
| Bleaching | 1 min. and 00 sec. | 38° C. |
| Bleaching-fixing | 3 min. and 15 sec. | 38° C. |
| Water washing (1) | 40 sec. | 35° C. |
| Water washing (2) | 1 min. and 00 sec. | 35° C. |
| Stabilization | 40 sec. | 38° C. |
| Drying | 1 min. and 15 sec. | 55° C. |

Compositions of process solutions as shown below:

| | (Unit g) |
|---|---|
| (Color developing solution) | |
| Diethylenetriaminetetraacetic acid | 1.0 |
| 1-Hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N—Ethyl-N—(β-hydroxyethyl)amino-2-methylnmiline sulfate | 4.5 |
| Water to | 1.0 l |
| pH | 10.05 |
| (Bleaching solution) | |
| Ferric ammonium ethylenediaminetetraacetate dihydrate | 120.0 |
| Disodium ethylenediaminetetraacetate | 10.0 |
| Ammonium bromide | 100.0 |
| Ammonium nitrate | 10.0 |
| Bleach acclerator | 0.005 mol |

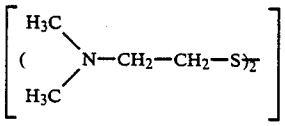

| | |
|---|---|
| Ammonia water (27%) | 15.0 ml |
| Water to | 1.0 l |
| pH | 6.3 |
| (Bleach-fixing solution) | |
| Ferric ammonium ethylenediaminetetraacetate dihydrate | 50.0 |
| Disodium ethylenediaminetetraacetate | 5.0 |
| Sodium sulfite | 12.0 |
| Aqueous ammonium thiosulfate solution (70%) | 240.0 ml |
| Ammonia water (27%) | 6.0 ml |
| Water to | 1.0 l |
| pH | 7.2 |

Water washing solution

Tapwater was passed through a multi-bed column packed with an H-type strongly acidic cation exchange regin (Amberlite IR-120B manufactured by Rohm and Haas Co.) and an OH-type anion exchange regin (Amberlite IR-400 manufactured by Rohm and Haas Co.) to reduce concentrations of calcium and magnesium ions below 3 mg/l. Then, 20 mg/l of sodium dichloroisocyanurate and 1.5 g/l of sodium sulfate were added thereto. The pH of the resulting water washing solution is 6.5 to 7.5.

| (Stabilizing solution) | (Unit g) |
|---|---|
| Formalin (37%) | 2.0 ml |
| Polyoxyethylene-p-monononylphenyl ether (Average polymerization degree 10) | 0.3 |
| Disodium ethylenediaminetetraacetate | 0.05 |
| Water to | 1.0 l |
| pH | 5.0–8.0 |

EXAMPLE 5

Samples 301 to 314 were evaluated in the same experimental condition as in Example 3 except that process steps were changed for those shown below, and almost the same results as exhibited in Table 3 were obtained.

| Step | Process time | Process temperature | Replenisher amount* | Tank capacity |
|---|---|---|---|---|
| Color development | 3 min. and 15 sec. | 38° C. | 15 ml | 20 l |
| Bleaching | 6 min. and 30 sec. | 38° C. | 10 ml | 40 l |
| Water washing | 2 min. and 10 sec. | 35° C. | 10 ml | 20 l |
| Fixing | 4 min. and 20 sec. | 38C. | 20 ml | 30 l |
| Water washing (1) | 1 min. and 05 sec. | 35° C. | Counter-flow piping method from (2) to (1) | 10 l |
| Water washing (2) | 1 min. and 00 sec. | 35° C. | 20 ml | 10 l |
| Stabilization | 1 min. and 05 sec. | 38° C. | 10 ml | 10 l |
| Drying | 4 min. and 20 sec. | 55° C. | | |

*per a width of 35 mm and a length of 1 m

Compositions of process solutions are described below.

| (Color developing solution) | Mother liquor (g) | Replenisher (g) |
|---|---|---|
| Diethylenetriaminetetraacetic | 1.0 | 1.1 |
| 1-Hydroxyethylidene-1,1-diphosphonic acid | 3.0 | 3.2 |
| Sodium sulfite | 4.0 | 4.9 |
| Potassium carbonate | 30.0 | 30.0 |
| Potassium bromide | 1.4 | — |
| Potassium iodide | 1.5 mg | — |
| Hydroxylamine sulfate | 2.4 | 3.6 |
| 4-(N—Ethyl-N—(β-hydroxyethyl)-amino)-2-methylaniline sulfate | 4.5 | 7.2 |
| Water to | 1.0 l | 1.0 l |
| pH | 10.05 | 10.10 |

| (Bleaching solution) | Mother liquor (g) | Replenisher (g) |
|---|---|---|
| Ferric sodium ethylenediamine-tetraaceate trihydrate | 100.0 | 140.0 |
| Disodium ethylenediaminetetraacetate | 10.0 | 11.0 |
| Ammonium bromide | 140.0 | 180.0 |
| Ammonium nitrate | 30.0 | 40.0 |
| Ammonia water (27%) | 6.5 ml | 2.5 ml |
| Water to | 1.0 l | 1.0 l |
| pH | 6.0 | 5.5 |

| (Fixing solution) | Mother liquor (g) | Replenisher (g) |
|---|---|---|
| Disodium ethylenediaminetetraacetate | 0.5 | 1.0 |
| Sodium sulfite | 7.0 | 12.0 |
| Sodium bisulfite | 5.0 | 9.5 |

-continued

| | | |
|---|---|---|
| Aqueous ammonium thiosulfate solution (70%) | 170.0 ml | 240.0 ml |
| Water to | 1.0 l | 1.0 l |
| pH | 6.7 | 6.6 |
| (Water washing solution) | common to mother liquor and replenisher | |

Tapwater was passed through a multi-bed column packed with an H-type strongly acidic cation exchange regin (Amberlite IR-120B manufactured by Rohm and Haas Co.) and an OH-type anion exchange regin (Amberlite IR-400 manufactured by Rohm and Haas Co.) to reduce concentrations of calcium and magnesium ions below 3 mg/l. Then, 20 mg/l of sodium dichloroisocyanurate and 1.5 g/l of sodium sulfate were added thereto. The pH of the resulting water washing solution is 6.5 to 7.5.

| (Stabilizing agent) | Mother liquor (g) | Replenisher (g) |
|---|---|---|
| Formalin (37%) | 2.0 ml | 3.0 ml |
| Polyoxyethylene-p-monononylphenyl ether (Average polymerization degree 10) | 0.3 | 0.45 |
| Disodium ethylenediaminetetraacetate | 0.05 | 0.08 |
| Water to | 1.0 l | 1.0 l |
| pH | 5.0–8.0 | 5.0–8.0 |

EXAMPLE 6

Samples 301 to 314 of Example 3 were evaluated in the same experimental condition as in Example 3 except that the process conditions were changed for those shown below, and almost the same results as therein were obtained.

| Step | Processing time | Processing temperature | Replenisher amount* | Tank capacity |
|---|---|---|---|---|
| Color development | 3 min 15 sec. | 37.8° C. | 40 ml | 10 l |
| Bleaching | 3 min. | 37.8° C. | 5 ml | 10 l |
| Fixing | 4 min. | 37.8° C. | 30 ml | 10 l |
| Stabilization (1) | 45 sec. | 35.0° C. | Counterflow piping method from (3) to (1) | 5 l |
| Stabilization (2) | 45 sec. | 35.0° C. | | 5 l |
| Stabilization | 45 sec. | 35.0° C. | 40 ml | 5 l |
| Drying | 1 min 20 sec. | 55.0° C. | | |

*per a width of 35 mm and a length of 1 m

Compositions of process solutions are described below.

| (Color developing solution) | Mother liquor (g) | Replenisher (g) |
|---|---|---|
| Diethylenetriaminepentaacetic acid | 5.0 | 6.0 |
| Sodium sulfite | 4.0 | 4.4 |
| Potassium carbonate | 30.0 | 37.0 |
| Potassium bromide | 1.3 | 0.9 |
| Potassium iodide | 1.2 mg | — |
| Hydroxylamine sulfate | 2.0 | 2.8 |
| 4-(N—Ethyl-N—(β-hydroxyethyl)-amino)-2-methylaniline sulfate | 4.7 | 5.3 |
| Water to | 1.0 l | 1.0 l |
| pH | 10.00 | 10.05 |

| (Bleaching solution) | Mother liquor (g) | Replenisher (g) |
|---|---|---|
| Ferric ammonium ethylenediaminetetraacetate dihydrate | 70.0 | 120.0 |
| Ferric 1,3-diaminopropanetetrtaacetate | 35.0 | 55.0 |
| Ethylenediaminetetraacetic acid | 4.0 | 5.0 |
| Ammonium bromide | 100.0 | 160.0 |
| Ammonium nitrate | 30.0 | 50.0 |
| Ammonia water (27%) | 20.0 ml | 23.0 ml |
| Acetic acid (98%) | 9.0 ml | 15.0 ml |
| Water to | 1.0 l | 1.0 l |
| pH | 5.5 | 4.5 |

| (Fixing solution) | Mother liquor (g) | Replenisher (g) |
|---|---|---|
| Disodium ethylenediaminetetraacetate | 0.5 | 0.7 |
| Sodium sulfite | 7.0 | 8.0 |
| Sodium bisulfite | 5.0 | 5.5 |
| Aqueous ammonium thiosulfate solution (70%) | 170.0 ml | 200.0 ml |
| Water to | 1.0 l | 1.0 l |
| pH | 6.7 | 6.6 |

| (Stabilizing solution) | common to mother liquor and replenisher |
|---|---|
| Formalin (37%) | 1.2 ml |
| 5-Chloro-2-methyl-4-isothiazolin-3-one | 6.0 mg |
| 2-Methyl-4-isothiazolin-3-one | 3.0 mg |
| Surfactant $[C_{10}H_{21}—O—(CH_2CH_2O)_{10}—H]$ | 0.4 g |
| Ethylene glycol | 1.0 g |
| Water to | 1.0 l |
| pH | 5.0–7.0 |

EXAMPLE 7

Preparation of sample 401

Malti-layered color light-sensitive material, which is herein referred to as sample 401, was prepared by applying in layers each of the layers having the following compositions on a cellulose triacetate film support which had been undercoated.

(Composition of light-sensitive layer)

Figure corresponding to each component means a coated amount represented by a unit of g/m$^2$, and means a coated amount in terms of silver amount for silver halide. However, as for each of the sensitizing dyes, figure corresponding thereto means a coated amount represented by moles per 1 mole of the silver halide in the same layer.

(Sample 401)

The 1st layer (Antihalation layer)
Black colloidal silver 0.18 as silver, gelatin .040
The 2nd layer (Intermediate layer)
2,5-Di-t-pentadecyl-hydroquinone 0.18, Cpd-30 0.07, Cpd-31 0.02, UV-1 0.08, UV-2 0.08, Oil-1 0.10, Oil-2 0.02, Gelatin 1.04
The 3rd layer (The 1st red-sensitive emulsion layer)
Silver iodobromide emulsion (6 mole % silver iodide, average grain size 0.8 μm) 0.55 (silver), SD-96.9×10$^{-5}$, SD-5 1.8×10$^{-5}$, SD-10 3.1×10$^{-4}$, SD-11 4.0×10$^{-5}$, Cpd-8 0.350, Oil-1 0.005, Cpd-34 0.008, Gelatin 1.20
The 4th layer (The 2nd red-sensitive emulsion layer)
Silver iodobromide emulsion (8 mole % silver iodide, average grain size 0.85 μm) 1.20 (silver), SD-9

$5.1\times10^{-5}$, SD-5 $1.4\times10^{-5}$, SD-10 $2.3\times10^{-4}$, SD-11 $3.0\times10^{-5}$, Cpd-8 0.300, Cpd-31 0.050, Cpd-9 0.004, Oil-2 0.050, Gelatin 1.30

The 5th layer (The 3rd red-sensitive emulsion layer)

Silver iodobromide emulsion (14 mole % silver iodide, average grain size 1.5 μm) 1.60 (silver), SD-12 $5.4\times10^{-5}$, SD-5 $1.4\times10^{-5}$, SD-10 $2.4\times10^{-4}$, SD-11 $3.1\times10^{-5}$, Cpd-32 0.150, Cpd-31 0.055, Cpd-24 0.060, Cpd-34 0.005, Oil-1 0.32, Gelatin 1.63 the 6th layer (Intermediate layer)

Gelatin 1.06

The 7th layer (The 1st green-sensitive emulsion layer)

Silver iodobromide emulsion (6 mole % silver iodide, average grain size 0.8 μm) 0.40 (silver), II-2 $2.2\times10^{-4}$, III-2 $1.0\times10^{-4}$, I-7 $1.8\times10^{-4}$, Cpd-33 0.260, Cpd-30 0.21, Cpd-4 0.030, Cpd-3 0.025, Oil-1 0.100, Gelatin 0.75

The 8th layer (The 2nd green-sensitive emulsion layer)

Silver iodobromide emulsion (9 mole % silver iodide, average grain size 0.85 μm) 0.80 (silver), II-2 $1.9\times10^{-4}$, III-2 $8.3\times10^{-5}$, I-7 $1.5\times10^{-4}$, Cpd-33 0.150, Cpd-3 0.010, Cpd-30 0.008, Cpd-4 0.012, Oil-1 0.60, Gelatin 1.10

The 9th layer (The 3rd green-sensitive emulsion layer)

Silver iodobromide emulsion (12 mole % silver iodide, average grain size 1.3 μm) 1.2 (silver), II-2 $1.5\times10^{-4}$, III-2 $7.0\times10^{-5}$, I-7 $1.3\times10^{-4}$, Cpd-33 0.065, Cpd-30 0.025, Oil-2 0.55, Gelatin 1.74

The 10th layer (yellow filter layer)

Yellow colloidal silver 0.05 (silver), 2,5-Di-t-pentadecylhydroquinone 0.03, Gelatin 0.95

The 11th layer (The 1st blue-sensitive emulsion layer)

Silver iodobromide emulsion (6 mole % silver iodide, average grain size 0.6 μm) 0.24 (silver), SD-6 $3.5\times10^{-4}$, Cpd-29 0.85, Cpd-3 0.12, Oil-1 0.28, Gelatin 1.28

The 12th layer (The 2nd blue-sensitive emulsion layer)

Silver iodobromide emulsion (10 mole % silver iodide, average grain size 1.0 μm) 0.45 (silver), SD-6 $2.1\times10^{-4}$, Cpd-29 0.20, Cpd-9 0.15, Oil-1 0.03, Gelatin 0.46

The 13th layer (The 3rd blue-sensitive emulsion layer)

Silver iodobromide emulsion (10 mole % silver iodide, average grain size 1.8 μm) 0.77 (silver), SD-6 $2.2\times10^{-4}$, Cpd-29 0.20, Oil-1 0.07, Gelatin 0.69

The 14th layer (The 1st protective layer)

Silver iodobromide emulsion (1 mole % silver iodide, average grain size 0.07 μm) 0.5 (silver), UV-1 0.11, UV-2 0.17, Oil-1 0.90, Gelatin 1.00

The 15th layer (The 2nd protective layer)

Polymethyl acrylate grain (diameter about 1.5 μm) 0.54, S-1 0.05, S-2 0.20, Gelatin 0.72

Besides the above components, gelatin-hardening agent H-1 and a surfacant were added to each of the layers.

Cpd-30

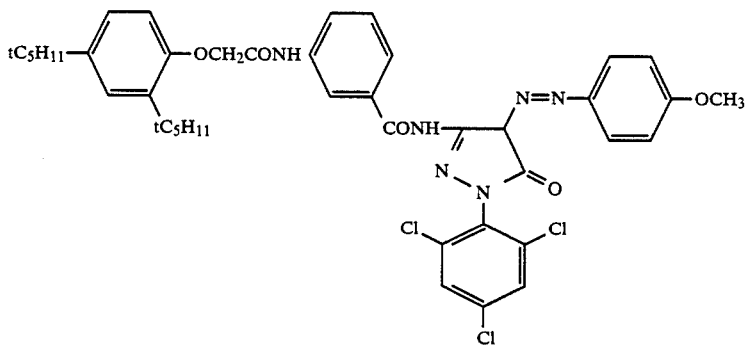

Cpd-31

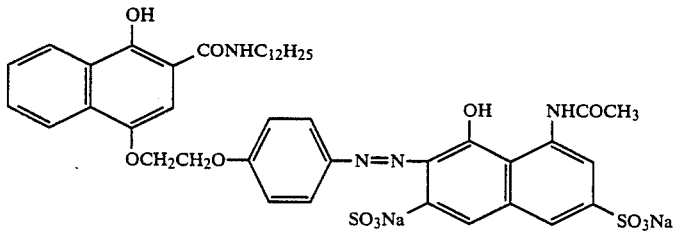

-continued
Cpd-32
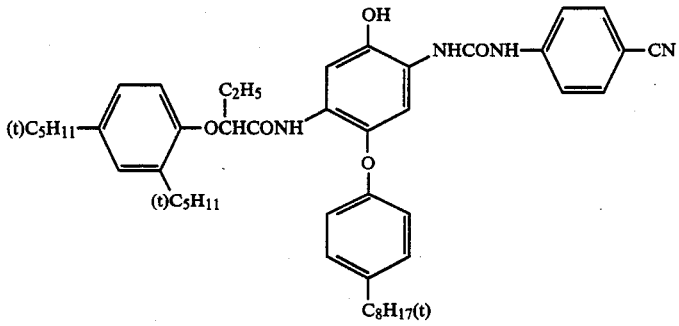
Cpd-33
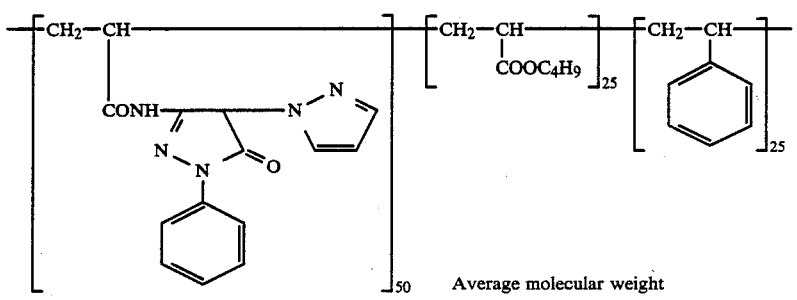
Average molecular weight
Cpd-34
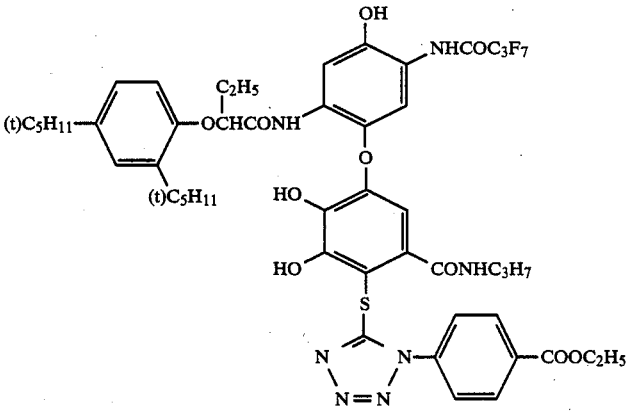
(A coupler disclosed in U.S. Pat. No. 3,227,554)
Cpd-35
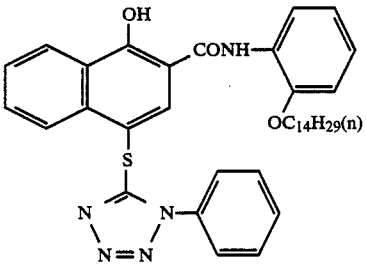
Tri-n-hexyl phosphate — Oil 5
SD-9
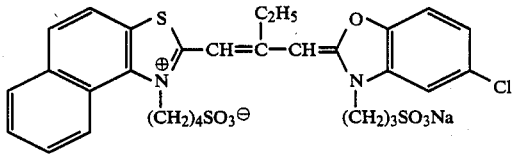

-continued

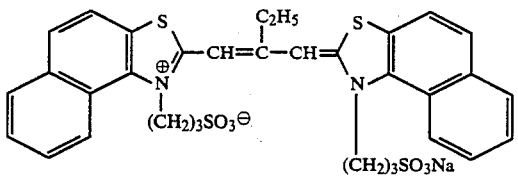

SD-10

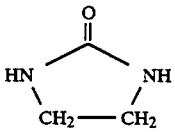

S-2

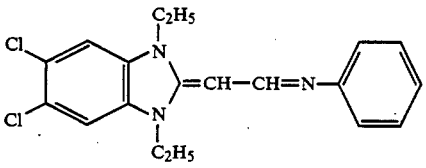

SD-11

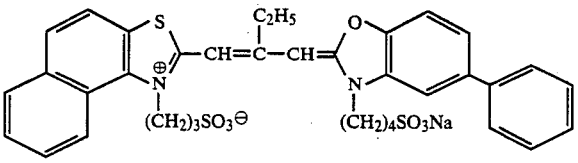

SD-12

The thus prepared sample was named sample 401. Samples 402 to 408 were similarly prepared using the same composition with sample 401 except sensitizing dye I-7 of the 7th, 8th and 9th layers was changed for those described in Table 4.

These photographic elements were, in the same manner as in Example 3, each subjected to exposure to light and development as such or after preservation under the same condition in Example 3, and then measured for fog and sensitivity. The results are shown in Table 4.

EXAMPLE 8

A multi-layered color light-sensitive material was prepared by providing each of the layers having the following compositions on a cellulose triacetate film support which had been undercoated, and named sample 501.

The 1st layer (Antihalation layer)

Gelatin layer (dry film thickness 2 μm) containing 0.25 g/m² black colloidal silver, 0.04 g/m² UV-3, 0.1 g/m² UV-4, 0.1 g/m² UV-5 and 0.1 cc/m² Oil-2

TABLE 4

| Sample No. | The 7th layer sensitizing dye | | The 8th layer sensitizing dye | | The 9th layer sensitizing dye | | Fresh performance | | After a preservation for 3 days (50° C., 80% RH) | |
|---|---|---|---|---|---|---|---|---|---|---|
| | Species | Amount mol/mol Ag | Species | Amount mol/mol Ag | Species | Amount mol/mol Ag | Fog | Relative sensitivity | Fog | Relative sensitivity |
| 401 (Present invention) | I-7 | $1.8 \times 10^{-4}$ | I-7 | $1.5 \times 10^{-4}$ | I-7 | $1.3 \times 10^{-4}$ | ±0 (Standard of fog) | 100 (Standard of sensitivity) | +0.04 | 95 |
| 402 (Present invention) | I-19 | $1.8 \times 10^{-4}$ | I-19 | $1.5 \times 10^{-4}$ | I-19 | $1.3 \times 10^{-4}$ | −0.02 | 97 | +0.01 | 93 |
| 403 (Present invention) | I-5 | $1.8 \times 10^{-4}$ | I-5 | $1.5 \times 10^{-4}$ | I-5 | $1.3 \times 10^{-4}$ | +0.02 | 102 | +0.05 | 93 |
| 404 (Comparative example) | SD-1 | $1.8 \times 10^{-4}$ | SD-1 | $1.5 \times 10^{-4}$ | SD-1 | $1.3 \times 10^{-4}$ | +0.18 | 104 | +0.35 | 77 |
| 405 (Comparative example) | SD-7 | $1.8 \times 10^{-4}$ | SD-7 | $1.5 \times 10^{-4}$ | SD-7 | $1.3 \times 10^{-4}$ | +0.09 | 86 | +0.14 | 65 |
| 406 (Comparative example) | SD-2 | $1.8 \times 10^{-4}$ | SD-2 | $1.5 \times 10^{-4}$ | SD-2 | $1.3 \times 10^{-4}$ | +0.21 | 93 | +0.47 | 66 |
| 407 (Comparative example) | SD-8 | $1.8 \times 10^{-4}$ | SD-8 | $1.5 \times 10^{-4}$ | SD-8 | $1.3 \times 10^{-4}$ | +0.11 | 87 | +0.18 | 70 |
| 408 (Comparative example) | SD-3 | $1.8 \times 10^{-4}$ | SD-3 | $1.5 \times 10^{-4}$ | SD-3 | $1.3 \times 10^{-4}$ | +0.06 | 83 | +0.13 | 64 |

The 2nd layer (Intermediate layer)

Gelatin layer (dry film thickness 1 μm) containing 0.05 g/m² H-1 and 0.05 cc/m² Oil-1

The 3rd layer (The 1st red-sensitive emulsion layer)

Gelatin layer (dry film thickness 1 μm) containing 0.5 g/m² (as silver amount) monodispersed silver iodobromide emulsion which was spectrally sensitized with 1.4 g/m² SD-13 and 0.06 mg/m² SD-14 (Iodine content 4 mole %, cube, average grain size 0.3 μm), 0.2 g/m² Cpd-36, 0.05 g/m² Cpd-37 and 0.12 cc/m² Oil-1

The 4th layer (The 2nd red-sensitive emulsion layer)

Gelatin layer (dry film thickness 2.5 μm) containing 0.8 g/m² (as silver amount) monodispersed silver iodobromide emulsion which was spectrally sensitized with 1.6 g/m² SD-13 and 0.06 mg/m² SD-14 (Iodine content 2.5 mole %, tetradecahedron, average grain size 0.55 μm), 0.55 g/m² Cpd-36, 0.14 g/m² Cpd-37 and 0.33 cc/m² Oil-2

The 5th layer (Intermediate layer)

Gelatin layer (dry film thickness 1 μm) containing 0.1 g/m² H-1 and 0.1 cc/m² Oil-1

The 6th layer (The 1st green-sensitive emulsion layer)

Gelatin layer (dry film thickness 1 μm) containing 0.7 g/m² (as silver amount) silver iodobromide emulsion spectrally sensitized with 3.3 mg/m² II-3 and 1.5 mg/m² I-7 (Iodine content 3 mole %, average grain size 0.3 μm), 0.35 g/m² Cpd-20 and 0.26 cc/m² Oil-1

The 7th layer (The 2nd green-sensitive emulsion layer)

Gelatin layer (dry film thickness 2.5 μm) containing 0.7 g/m² (as silver amount) tabular silver iodobromide emulsion spectrally sensitized with 1.2 mg/m² II-3 and 0.6 mg/m² I-7 (Iodine content 2.5 mole %, grains having a diameter/thickness ratio of 5 or more amounting to 50% of projected area of all the grains, average thickness of grains 0.10 μm), 0.25 g/m² Cpd-38 and 0.05 cc/m² Oil-1

The 8th layer (Intermediate layer)

Gelatin layer (dry film thickness 1 μm) containing 0.05 g/m² H-1 and 0.1 cc/m² Oil-1

The 9th layer (Yellow filter layer)

Gelatin layer (dry film thickness 1 μm) containing 0.1 g/m² yellow colloidal silver, 0.02 g/m² H-1, 0.03 g/m² Cpd-41 and 0.04 cc/m² Oil-1

The 10th layer (The 1st blue-sensitive emulsion layer)

Gelatin layer (dry film thickness 1.5 μm) containing 0.6 g/m² (as silver amount) silver iodobromide emulsion spectrally sensitized with 1.0 mg/m² SD-15 (Iodine content 2.5 mole %, average grain size 0.7 μm), 0.5 g/m² Cpd-39 and 0.1 cc/m² Oil-1

The 11th layer (The 2nd blue-sensitive emulsion layer)

Gelatin layer (dry film thickness 3 μm) containing 1.1 g/m² (as silver amount) tabular silver iodobromide emulsion spectrally sensitized with 1.7 mg/m² SD-15 (Iodine content 2.5 mole %, grains having a diameter/thickness ratio of 5 or more amounting to 50% of projected area of all the grains, average thickness of grains 0.13 μm), 1.2 g/m² Cpd-39 and 0.23 cc/m² Oil-1

The 12th layer (The 1st protective layer)

Gelatin layer (dry film thickness 2 μm) containing 0.02 g/m² UV-3, 0.03 g/m² UV-4, 0.03 g/m² UV-5, 0.29 g/m² UV-6 and 0.28 cc/m² Oil-2

The 13th layer (The 2nd protective layer)

Gelatin layer (dry film thickness 0.8 μm) containing 0.1 g/m² (as silver amount) of emulsion of fine silver iodobromide grains whose surfaces were fogged (Iodine content 1 mole %, average grain size 0.06 μm), and 2.7 g/m² of polymethyl methacrylate grains (average grain size 1.5 μm)

Besides the above components, gelatin hardening agent H-3 and a surfactant were added to each layer.

Compound used for preparation of the sample are illustrated below.

Cpd-36

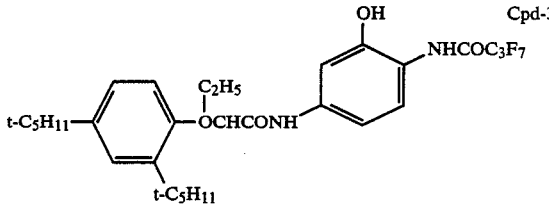

Cpd-37

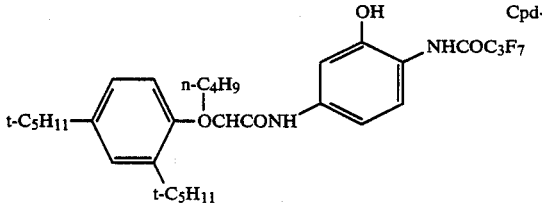

Cpd-38

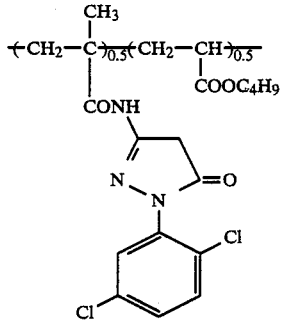

Cpd-39

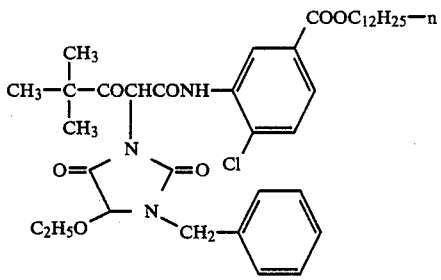

UV-3

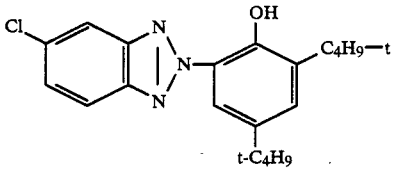

UV-4

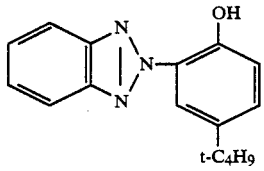

-continued

UV-5

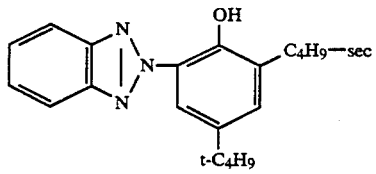

UV-6

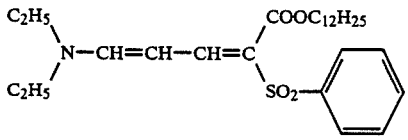

Cpd-40

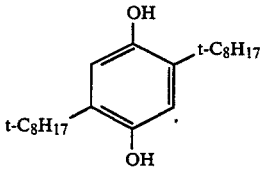

Cpd-41

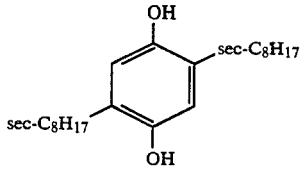

SD-13

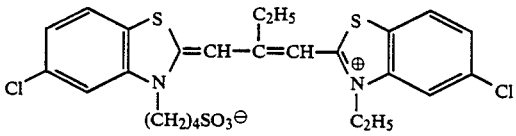

SD-14

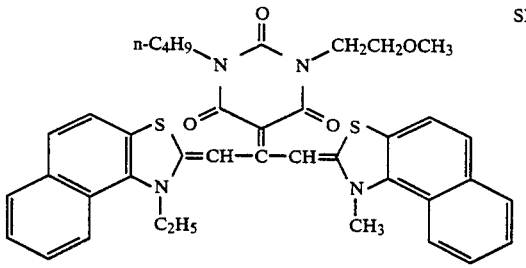

SD-15

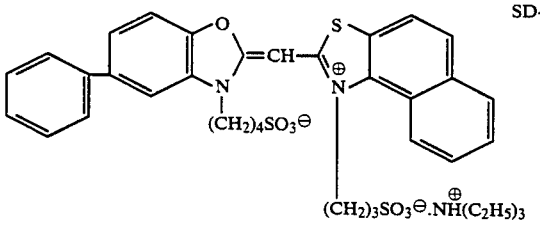

The thus prepared sample was named sample 501. Samples 501 to 508 were similarly prepared using the same composition with sample 501 except that sensitizing dye I-7 of the 6th and 7th layers were changed for those described in Table 5.

These photographic elements were, in the same manner as in Example 3, each subjected to exposure to light and the following process as such or after preservation under the same condition in Example 3, and then measured for fog and sensitivity. The results are shown in Table 5.

In this connection, extent of fog of each sample of fresh performance or after the preservation was relatively expressed by measuring maximum color density of each sample after color development and comparing it with that of sample 501 of fresh performance, howering of relative value in comparison with the standard value shows increase of fog.

| Process steps | | |
|---|---|---|
| Step | Time | Temperature |
| First development | 6 minutes | 38° C. |
| Water washing | 2 minutes | 38° C. |
| Reversal | 2 minutes | 38° C. |
| Color development | 6 minutes | 38° C. |
| Adjustment | 2 minutes | 38° C. |
| Bleaching | 6 minutes | 38° C. |
| Fixing | 4 minutes | 38° C. |
| Water washing | 4 minutes | 38° C. |
| Stabilization | 1 minute | Ambient temperature |
| Drying | | |

Compositions of the processing solutions used are as follows.

| | |
|---|---|
| **(First developing solution)** | |
| Water | 700 ml |
| Pentasodium nitrilo-N,N,N—trimethylenephosphonate | 2 g |
| Sodium sulfite | 20 g |
| Hydroquinone monosulfonate | 30 g |
| Sodium carbonate monohydrate | 30 g |
| 1-Phenyl-4-methyl-4-hydroxymethyl-3-pyrazolidone | 2 g |
| Potassium bromide | 2.5 g |
| Potassium thiocyanate | 1.2 g |
| Potassium iodide (0.1% solution) | 2 ml |
| Water to | 1 l |
| **(Reversal solution)** | |
| Water | 700 ml |
| Pentasodium nitrilo-N,N,N—trimethylenephosphonate | 3 g |
| Tin (II) chloride dihydrate | 1 g |
| p-Aminophenol | 0.1 g |
| Sodium hydroxide | 8 g |
| Glacial acetic acid | 15 ml |
| Water to | 1 l |
| **(Color developing solution)** | |
| Water | 700 ml |
| Pentasodium nitrilo-N,N,N—trimethylenephosphonate | 3 g |
| Sodium sulfite | 7 g |
| Sodium tertiary phosphate dodecahydrate | 36 g |
| Potassium bromide | 1 g |
| Potassium iodide (0.1% solution) | 90 ml |
| Sodium hydroxide | 3 g |
| Citrazinic acid | 1.5 g |
| N—Ethyl-N—(-methanesulfonamidoethyl)-3-methyl-4-aminoaniline sulfate | 11 g |
| 3,6-Dithiaoctane-1,8-diol | 1 g |
| Water to | 1 l |
| **(Conditioning solution)** | |
| Water | 700 ml |
| Sodium sulfite | 12 g |
| Disodium ethylenediaminetetraacetate dihydrate | 8 g |
| Thioglycerine | 0.4 ml |
| Glacial acetic acid | 3 ml |
| Water to | 1 l |
| **(Bleaching solution)** | |
| Water | 800 ml |
| Disodium ethylenediaminetetraacetate dihydrate | 2 g |
| Ferric ammonium ethylenediaminetetra-acetate dihydrate | 120 g |
| Potassium bromide | 100 g |
| Water to | 1 l |

-continued

| (Fixing solution) | |
|---|---|
| Water | 800 ml |
| Sodium thiosulfate | 80.0 g |
| Sodium sulfite | 5.0 g |
| Sodium bisulfite | 5.0 g |
| Water to | 1 l |
| **(Stabilizing solution)** | |
| Water | 800 ml |
| Formalin (37 weight %) | 5.0 ml |
| FUJI DRIWEL (Surfactant manufactured by FUJI PHOTO FILM CO. LTD.) | 5.0 ml |
| Water to | 1 l |

Similar results were also obtained when water washing was conducted by using the following water washing solution in place of water.

| (Water washing solution) | |
|---|---|
| Disodium ethylenediaminetetraacetate | 0.4 g |
| Water to | 1 l |
| pH (with sodium hydroxide) | 7.0 |

(Light-sensitive layer construction)

Figures corresponding to respective components mean coated amounts represented by the unit of $8/m^2$, and mean coated amounts in terms of silver for silver halide.

| The 1st layer (Blue-sensitive layer) | |
|---|---|
| Silver chlorobromide emulsion (80 mole % silver bromide) | silver 0.30 |
| Yellow coupler Cpd-42 | 0.70 |
| Oil-6 | 0.15 |
| Gelatin | 0.20 |
| **The 2nd layer (Intermediate layer)** | |
| Gelatin | 0.90 |
| Di-t-octylhydroquinone | 0.05 |
| Oil-2 | 0.10 |
| **The 3rd layer (Green-sensitive layer)** | |
| Refer to Table 6 | |
| **The 4th layer (Ultraviolet rays-absorptive intermediate layer)** | |
| Ultraviolet absorber (UV-3/UV-7/UV-5) | 0.06/0.25/0.25 |
| Oil-6 | 0.20 |
| Gelatin | 1.5 |
| **The 5th layer (Red-sensitive layer)** | |
| Silver chlorobromide emulsion (70 mole % silver bromide) | silver 0.20 |
| Cyan coupler (Cpd-43/Cpd-44) | 0.2/0.2 |
| Coupler solvent (Oil-6/Oil-2) | 0.10/0.20 |
| Gelatin | 0.9 |
| **The 6th layer (Ultraviolet rays-absorptive intermediate layer)** | |
| Ultraviolet absorber (UV-3/UV-7/UV-5) | 0.06/0.25/0.25 |
| Oil-2 | 0.20 |
| Gelatin | 1.5 |
| **The 7th layer (Protective layer)** | |
| Hardening agent H-2 | 0.28 |
| Gelatin | 1.5 |

TABLE 5

| Sample No. | The 6th layer Sensitizing dye Species | Amount mg/m² | The 7th layer Sensitizing dye Species | Amount mg/m² | Fresh performance Maximum color density | Relative sensitivity | After preservation for 3 days (50° C. 80% RH) Maximum color density | Relative sensitivity |
|---|---|---|---|---|---|---|---|---|
| 501 (Present invention) | I-7 | 1.5 | I-7 | 0.6 | ±0 (standard of max. color density) | 100 (standard of sensitivity | −0.05 | 95 |
| 502 (Present invention) | I-19 | 1.5 | I-19 | 0.6 | ±0 | 98 | −0.06 | 94 |
| 503 (Present invention) | I-5 | 1.5 | I-5 | 0.6 | −0.02 | 101 | −0.08 | 97 |
| 504 (Comparative example) | SD-1 | 1.5 | SD-1 | 0.6 | −0.25 | 103 | −0.41 | 75 |
| 505 (Comparative example) | SD-7 | 1.5 | SD-7 | 0.6 | −0.13 | 90 | −0.25 | 66 |
| 506 (Comparative example) | SD-2 | 1.5 | SD-2 | 0.6 | −0.32 | 95 | −0.49 | 63 |
| 507 (Comparative example) | SD-8 | 1.5 | SD-8 | 0.6 | −0.15 | 90 | −0.25 | 69 |
| 508 (Comparative example) | SD-3 | 1.5 | SD-3 | 0.6 | −0.09 | 84 | −0.20 | 65 |

EXAMPLE 9

Light-sensitive layers comprising the following 1st to 7th layers were each provided on a paper support, both surfaces of which had been laminated with polyethylene to prepare color light-sensitive material samples 601 to 608. The polyethylene on the side where the 1st layer was provided contains titanium dioxide and a trace amount of ultramarine blue.

Cpd-42

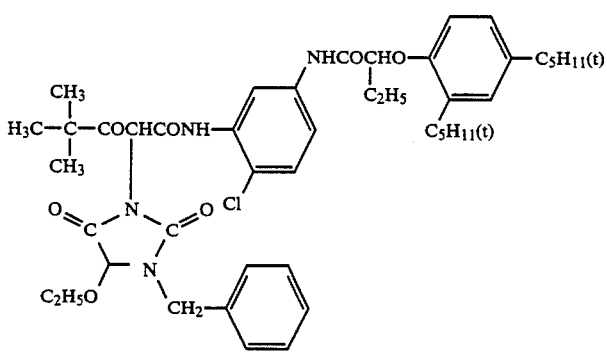

Oil-6

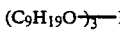

UV-7

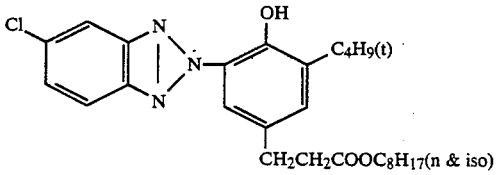

Cpd-43

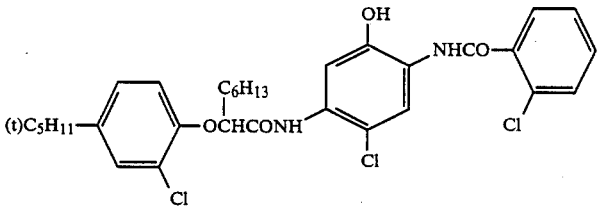

Cpd 44

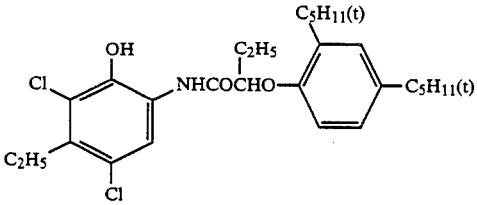

H-2

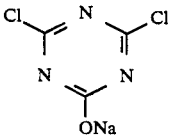

The following compounds were used as spectrally sensitizing dyes for the blue-sensitive emulsion layer and the red-sensitive emulsion layer.

Blue-sensitive emulsion layer SD-6

($2\times10^{-4}$ moles thereof was added per 1 mole of silver halide)

Red-sensitive emulsion layer SD-16

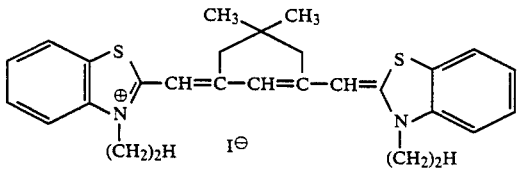

($2.5\times10^{-4}$ moles thereof was added per 1 mole of silver halide)

The following dyes were used as irradiation-inhibiting dyes for respective emulsion layers.

Green-sensitive emulsion layer

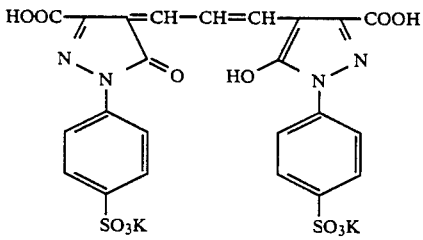

Red-sensitive emulsion layer

-continued

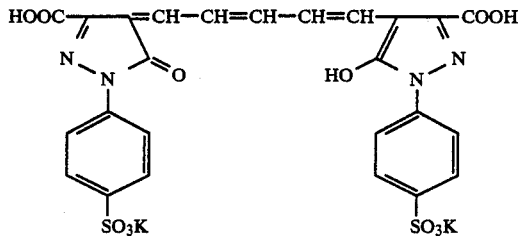

As for the green-sensitive emulsion layer, silver chlorobromide emulsion (silver chloride content 30 mole %) comprising monodispersed cubic grains having an average grain size of 0.4 μm was used, chemical sensitization was conducted by adding $2.0\times10^{-5}$ moles of sodium thiosulfate per 1 mole of silver halide, 4-hydroxy-6-methyl-(1,3,3a,7)-tetrazaidene was used as a stabilizing agent in an amount of 300 mg per 1 mole of silver halide, and combination of spectral sensitizing dyes in Table 6 was used.

Further, as an emulsified dispersion, an emulsified dispersion was used which was prepared by dissolving 100 g of Cpd-20, a magenta coupler together with 50 g of Cpd-45, a fading inhibitor in a mixture of 200 ml of Oil-7 (a solvent) and 100 ml of ethyl acetate, and emulsifying and dispersing the solution in 2,000 g of an aqueous 10% gelatin solution containing 8.0 g of sodium dodecylbenzenesulfonate.

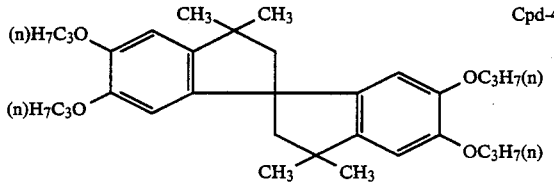

Cpd-45

Oil-7

$(C_8H_{17}O)_3P{=}O$

Amount of the emulsion applied as the 3rd layer was 200 mg/m² in terms of silver amount.

| Emulsified dispersion | |
|---|---|
| Emulsified dispersion 2 | |
| Magenta coupler Cpd-20 | 600 mg/m² |
| Fading inhibitor Cpd-45 | 300 mg/m² |
| Coupler solvent Oil-7 | 1.20 ml/m² |

(Gelatin was added to the coating solution so that coated gelatin amount becomes 1800 mg/m²)

In order to confirm preservability of these coating samples, they were examined for change of photographic performance after preservation for 4 weeks in a state of 50° C. and 45% RH as a forced test. The samples before and after preservation were each subjected to gradation exposure to light for sensitometry using an enlarging machine (FUJI COLOR HEAD 690 manufactured by FUJI PHOTO FILM CO., LTD.) through a green filter, and then subjected to developing process comprising the following process steps.

| Process step | Temperature | Time |
|---|---|---|
| Developing solution | 33° C. | 3.5 minutes |
| Bleach-fixing solution | 33° C. | 1.5 minutes |
| Water washing | 28–35° C. | 3.0 minutes |

| (Developing solution) | |
|---|---|
| Diethylenetriaminepentaacetic acid | 1.0 g |
| Benzyl alcohol | 15 ml |
| Diethylene glycol | 10 ml |
| $Na_2SO_3$ | 2.0 g |
| KBr | 0.5 g |
| Hydroxylamine sulfate | 3.0 g |
| 4-Amino-3-methyl-N—ethyl-N—[β-(methanesulfonamido)ethyl]-p-phenylenediamine sulfate | 5.0 g |
| $Na_2CO_3$ monohydrate | 30 g |
| Water to | 1 l |
| pH | 10.1 |
| (Bleach-fixing solution) | |
| Ammonium thiosulfate (54 wt %) | 150 ml |
| $Na_2SO_3$ | 15 g |
| $NH_4[Fe(EDTA)]$ | 55 g |
| Disodium ethylendiaminetetraacetate dihydrate | 4 g |
| Water to | 1 l |
| pH | 6.9 |

The thus treated samples were each measured for color density, and changes of sensitivity and fog after preservation in comparison with fresh performance were determined. The results are shown in Table 6.

TABLE 6

| Sample No. | The 3rd layer sensitizing dye: Species | Amount | Species | Amount | Fresh performance: Fog | Relative sensitivity | After preservation for 4 weeks (50° C., 45% RH): Fog | Relative Sensitivity |
|---|---|---|---|---|---|---|---|---|
| 601 (Present invention) | I-5 | $1.7\times10^{-4}$ mol/mol Ag | II-2 | $3.2\times10^{-4}$ mol/mol Ag | ±0 (Standard of fog) | 100 (standard of sensitivity) | +0.04 | 96 |
| 602 (Present invention) | I-7 | $1.7\times10^{-4}$ mol/mol Ag | " | $3.2\times10^{-4}$ mol/mol Ag | +0.01 | 98 | +0.04 | 95 |
| 604 (Comparative example) | SD-1 | $1.7\times10^{-4}$ mol/mol Ag | " | $3.2\times10^{-4}$ mol/mol Ag | +0.12 | 103 | +0.25 | 86 |
| 605 (Comparative example) | SD-7 | $1.7\times10^{-4}$ mol/mol Ag | " | $3.2\times10^{-4}$ mol/mol Ag | +0.05 | 90 | +0.10 | 68 |
| 606 Comparative example) | SD-2 | $1.7\times10^{-4}$ mol/mol Ag | " | $3.2\times10^{-4}$ mol/mol Ag | +0.15 | 97 | +0.36 | 60 |
| 607 (Comparative example) | SD-8 | $1.7\times10^{-4}$ mol/mol Ag | " | $3.2\times10^{-4}$ mol/mol Ag | +0.05 | 86 | +0.10 | 65 |

TABLE 6-continued

| Sample No. | The 3rd layer sensitizing dye Species | Amount | Species | Amount | Fresh performance Fog | Relative sensitivity | After preservation for 4 weeks (50° C., 45% RH) Fog | Relative Sensitivity |
|---|---|---|---|---|---|---|---|---|
| 608 (Comparative example) | SD-3 | $1.7 \times 10^{-4}$ mol/mol Ag | " | $3.2 \times 10^{-4}$ mol/mol Ag | +0.03 | 86 | +0.12 | 61 |

As is seen from the foregoing description, it is possible to increase sensitivity of photographic light-sensitive materials and greatly inhibit increase of fog and lowering of sensitivity thereof during preservation by using in combination a spectrally sensitizing dye of the general formula (I), and spectrally sensitizing dye(s) of the general formula(e) (II) and/or (III).

What is claimed is:

1. A silver halide photographic emulsion which contains at least one of the compounds represented by the following general formula (I), and at least one compound selected from the group consisting of the compounds represented by the general formula (II) and the compounds represented by the general formula (III): General formula (I)

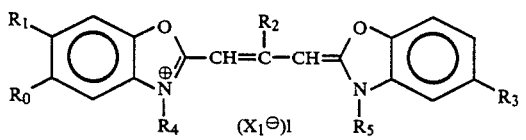

wherein $R_0$ and $R_1$ may be the same or different, and represent hydrogen atoms, unsubstituted or substituted alkyl groups, unsubstituted or substituted aryl groups, unsubstituted or substituted aryloxy groups, halogen atoms, unsubstituted or substituted alkoxycarbonyl groups, unsubstituted or substituted acylamino groups, unsubstituted or substituted acyl groups, cyano groups, unsubstituted or substituted carbamoyl groups, unsubstituted or substituted sulfamoyl groups, carboxyl groups or unsubstituted or substituted acyloxy groups under the condition that $R_0$ and $R_1$ do not represent hydrogen atoms at the same time; $R_2$ represents a hydrogen atom, an unsubstituted or substituted alkyl group, or an unsubstituted or substituted aryl group; $R_3$ represents an unsubstituted or substituted alkyl group having 2 or more carbon atoms, an unsubstituted or substituted aryl group, an unsubstituted or substituted aryloxy group, an acyl group having 3 or more carbon atoms, an acyloxy group having 3 or more carbon atoms, an alkoxycarbonyl group having 4 or more carbon atoms, or an acylamino group having 3 or more carbon atoms, and moreover $R_3$ is required to be a substituent having such L and B that S value is 544 or less in the equation of $$S=3.536L-2.661B+535.4$$

wherein L (its unit is Å) represents "L" as a STERIMOL parameter, and B (its unit is Å) represents the smaller value among $B_1=B_4$ and $B_2+B_3$ which are STERIMOL parameters, under the condition that $R_1$ and $R_3$, or $R_0$ and $R_3$ do not represent unsubstituted or substituted aryl groups at the same time; $R_4$ and $R_5$ may be the same, and represent unsubstituted or substituted alkyl groups; $X_1^-$ represents a counter anion; and l is 0 or 1, and when an inner salt is formed, l is 0; General formula (II)

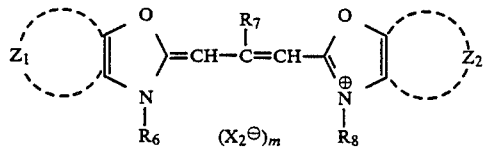

wherein $Z_1$ and $Z_2$ may be the same or different, and represent nonmetal atomic groups necessary for forming unsubstituted or substituted benzene rings, or unsubstituted or substituted naphthalene rings under the condition that $Z_1$ and $Z_2$ do not form unsubstituted or substituted naphthalene rings at the same time, and under the further condition that when $Z_1$ and/or $Z_2$ represent benzene rings having a substituent, the substituent does not represent a substituent defined as $R_3$; $R_7$ has the same significance with $R_2$; $R_6$ and $R_8$ have the same significances with $R_4$ and $R_5$ respectively; $X_2^-$ has the same significance with $X_1^-$; and n has the same significance with l; General formula (III)

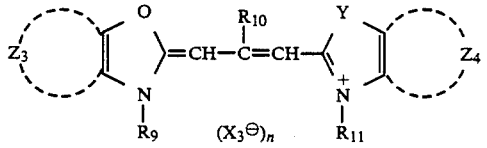

wherein $Z_3$ and $Z_4$ may be the same or different, and represent nonmetal atomic groups necessary for forming unsubstituted or substituted benzene rings; Y represents a sulfur atom or a selenium atom; $R_9$ and $R_{11}$ have the same significances with $R_4$ and $R_5$ respectively; $R_{10}$ has the same significance with $R_2$; $X_3^-$ has the same significance with $X_1^-$, and n has the same significance with l.

2. The silver halide photographic emulsion of claim 1 wherein in the definition of $R_0$ and $R_1$, the unsubstituted or substituted alkyl, aryl, aryloxy, alkoxycarbonyl, acyl and acyloxy groups each have 10 or less carbon atoms, the unsubstituted or substituted acylamino group has 8 or less carbon atoms, and the unsubstituted or substituted carbamoyl and sulfamoyl groups each have 6 or less carbon atoms.

3. The silver halide photographic emulsion of claim 2 wherein in the definition of $R_0$ and $R_1$, the unsubstituted or substituted alkyl groups are methyl, ethyl, propyl, isopropyl, n-butyl, branched butyl, n-pentyl, branched pentyl, vinylmethyl, cyclohexyl, benzyl, phenethyl, 3-phenylpropyl or trifluoromethyl groups; the unsubstituted or substituted aryl groups are phenyl, 4-methylphenyl, 4-chlorophenyl or naphthyl groups; the unsubstituted or substituted aryloxy groups are phenoxy, 4-methylphenoxy, 4-chlorophenoxy or naphthyloxy groups; the unsubstituted or substituted alkoxycarbonyl groups are methoxycarbonyl, ethoxycarbonyl or benzyloxycarbonyl groups; the unsubstituted or substituted acylamino groups are acetylamino, trifluoroacetylamino, propionylamino or benzoylamino groups; the unsubstituted or substituted acyl groups are acetyl, trifluoroacetyl, propionyl, benzoyl, p-chlorobenzoyl or mesyl groups; the unsubstituted or substituted carbamoyl groups are carbamoyl, N,N-dimethylcarbamoyl or morpholinocarbonyl groups; the unsubstituted or substituted sulfamoyl groups are sulfamoyl, N,N-dimethylsulfamoyl, morpholinosulfonyl or piperidinosulfonyl groups; and the unsubstituted or substituted acyloxy groups are acetyloxy, trifluoroacetyloxy, propionyloxy or benzoyloxy groups.

4. The silver halide photographic emulsion of claim 1 wherein in the definition of $R_2$, the unsubstituted or substituted alkyl group has 10 or less carbon atoms, and the unsubstituted or substituted aryl group has 10 or less carbon atoms.

5. The silver halide photographic emulsion of claim 4 wherein the unsubstituted or substituted alkyl group is a methyl, ethyl, propyl, butyl, benzyl, phenethyl or 3-phenylpropyl; and the unsubstituted or substituted aryl group is a phenyl or p-tolyl group.

6. The silver halide photographic emulsion of claim 1 wherein $R_3$ is an ethyl, propyl, isopropyl, branched butyl, branched pentyl, branched hexyl, cyclohexyl, branched octyl, benzyl, phenethyl or t-butylcarbonyloxy group.

7. The silver halide photographic emulsion of claim 1 wherein $R_4$ and $R_5$ are alkyl groups having 8 or less carbon atoms; aralkyl groups having 10 or less carbon atoms; or alkyl groups having 6 or less carbon atoms as substituted with a hydroxyl group, a carboxyl group, a sulfo group, a cyano group, a halogen atom, an alkoxycarbonyl group having 8 or less carbon atoms, an alkoxy group having 8 or less carbon atoms, an aryloxy group having 8 or less carbon atom, an acyloxy group having 8 or less carbon atoms, an acyl group having 8 or less carbon atoms, a carbamoyl group having 6 or less carbon atoms, a sulfamoyl group having 6 or less carbon atoms, or an aryl group having 10 or less carbon atoms.

8. The silver halide photographic emulsion of claim 7 wherein the definition of $R_4$ and $R_5$, the alkyl groups having 8 or less carbon atoms are methyl, ethyl, propyl, vinylmethyl, butyl, pentyl, hexyl, heptyl or octyl groups; and the aralkyl groups having 10 or less carbon atoms are benzyl, phenethyl or 3-phenylpropyl groups.

9. The silver halide photographic emulsion of claim 7 wherein with respect to the substituent of the alkyl group having 6 or less carbon atoms, the alkoxycarbonyl group having 8 or less carbon atoms is a methoxycarbonyl, ethoxycarbonyl or benzyloxycarbonyl group; the alkoxy group having 8 or less carbon atoms is a methoxy, ethoxy, butyloxy, benzyloxy or phenethyloxy group; the aryloxy group having 8 or less carbon atoms is a phenoxy or p-tolyloxy group; the acyloxy group having 8 or less carbon atoms is an acetyloxy, propionyloxy or benzoyloxy group; the acyl group having 8 or less carbon atoms is an acetyl, propionyl, benzoyl or 4-fluorobenzoyl group; the carbamoyl group having 6 or less carbon atoms is a carbamoyl, N,N-dimethylcarbamoyl, morpholinocarbonyl or piperidinocarbonyl group; the sulfamoyl group having 6 or less carbon atoms is a sulfamoyl, N,N-dimethylsulfamoyl, morpholinosulfonyl or piperidinosulfonyl group; and the aryl group having 10 or less carbon atoms is a phenyl, p-fluorophenyl, p-hydroxyphenyl, p-carboxyphenyl or p-sulfophenyl group.

10. The silver halide photographic emulsion of claim 1 wherein $X_1^-$ is an inorganic or organic acid anion.

11. The silver halide photographic emulsion of claim 10 wherein $X_1^-$ is chloride, bromide, iodide, p-toluenesulfonate, p-nitrobenzenesulfonate, methanesulfonate, methylsulfate, ethylsulfate or perchlorate.

12. The silver halide photographic emulsion of claim 1 wherein heterocyclic part formed by combination with $Z_1$ or $Z_2$ as represented as benzoxazoles is benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-butoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-amyloxybenzoxazole, 6-hydroxybenzoxazole, 5,6-dimethylbenzoxazole, 4,6-dimethylbenzoxazole, 5-ethoxybenzoxazole, naphtho[2,1-d]oxazole, naphtho[1,2-d]oxazole, naphthooxazole, or 5-nitronaphthooxazole.

13. The silver halide photographic emulsion of claim 1 wherein heterocyclic part formed by combination with $Z_3$ as represented as benzoxazoles is benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-butoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-amyloxybenzoxazole, 6-hydroxybenzoxazole, 5,6-dimethylbenzoxazole, 4,6-dimethylbenzoxazole, or 5-ethoxybenzoxazole; and heterocyclic part formed by combination with $Z_4$ as represented as benzothiazoles or benzoselenazoles is benzothiazole, benzoselenazole, 5-chlorobenzothiazole, 5-chlorobenzoselenazole, 5-methylbenzothiazole, 5-methylbenzoselenazole, 5-bromobenzothiazole, 5-bromobenzoselenazole, 5-fluorobenzothiazole, 5-fluorobenzoselenazole, 5-phenylbenzothiazole, 5-phenylbenzoselenazole, 5-methoxybenzothiazole, 5-methoxybenzoselenazole, 5-butoxybenzothiazole, 5-butoxybenzoselenazole, 5-nitrobenzothiazole, 5-nitrobenzoselenazole, 5-trifluoromethylbenzothiazole, 5-trifluoromethylbenzoselenazole, 5-hydroxybenzothiazole, 5-hydroxybenzoselenazole, 5-carboxybenzothiazole, 6-carboxybenzoselenazole, 6-methylbenzothiazole, 6-methylbenzoselenazole, 6-chlorobenzothiazole, 6-chlorobenzoselenazole, 6-nitrobenzothiazole, 6-nitrobenzoselenazole, 6-methoxybenzothiazole, 6-methoxybenzoselenazole, 6-amyloxybenzothiazole, 6-amyloxybenzoselenazole, 6-hydroxybenzothiazole, 6-hydroxybenzoselenazole, 5,6-dimethylbenzothiazole, 5,6-dimethylbenzoselenazole, 4,6-dimethylbenzothiazole, 4,6-dimethylbenzoselenazole, 5-ethoxybenzothiazole, 5-ethoxybenzoselenazole, 5-chloro-6-methylbenzothiazole, or 5-chloro-6-methylbenzoselenazole

14. The silver halide photographic emulsion of claim 1 wherein amounts of at least one of the compounds represented by the general formula (I) and at least one compound selected from the group consisting of the compounds represented by the general formula (II) and the compounds represented by the general formula (III) to be used are each $1\times10^{-6}$ to $5\times10^{-3}$ moles per mole of silver halide.

15. The silver halide photographic emulsion of claim 1 wherein the silver halide is silver bromide, silver iodobromide, silver iodochlorobromide, silver chlorobromide or silver chloride.

16. The silver halide photographic emulsion of claim 1 wherein silver halide grains have substantially two distinct layer structures composed of core part of a higher iodine content and shell part of a lower iodine content.

17. The silver photographic emulsion of claim 1 which further contains yellow color-magenta color-and cyan color-forming couplers.

* * * * *